US008631773B2

(12) United States Patent
Yamaguchi et al.

(10) Patent No.: US 8,631,773 B2
(45) Date of Patent: Jan. 21, 2014

(54) VALVE TIMING ADJUSTER

(75) Inventors: Takashi Yamaguchi, Obu (JP); Akihiko Takenaka, Anjo (JP); Toshiki Fujiyoshi, Okazaki (JP)

(73) Assignee: Denso Corporation, Kariya (JP)

( * ) Notice: Subject to any disclaimer, the term of this patent is extended or adjusted under 35 U.S.C. 154(b) by 452 days.

(21) Appl. No.: 12/905,315

(22) Filed: Oct. 15, 2010

(65) Prior Publication Data

US 2011/0088645 A1 Apr. 21, 2011

(30) Foreign Application Priority Data

Oct. 15, 2009 (JP) ..... 2009-238485

(51) Int. Cl.
*F01L 1/34* (2006.01)

(52) U.S. Cl.
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,302,072 | B1 * | 10/2001 | Sekiya et al. | 123/90.17 |
| 6,332,439 | B2 | 12/2001 | Sekiya et al. | |
| 6,334,414 | B1 * | 1/2002 | Okada et al. | 123/90.15 |
| 6,374,788 | B1 * | 4/2002 | Fukuhara et al. | 123/90.17 |
| 6,412,463 | B1 | 7/2002 | Kinugawa | |
| 6,460,496 | B2 * | 10/2002 | Fukuhara et al. | 123/90.17 |
| 6,484,678 | B2 * | 11/2002 | Kinugawa | 123/90.17 |
| 6,745,735 | B2 | 6/2004 | Smith | |
| 7,100,555 | B2 * | 9/2006 | Imaizumi et al. | 123/90.17 |
| 7,610,883 | B2 | 11/2009 | Noguchi | |
| 8,166,937 | B2 * | 5/2012 | Yamaguchi et al. | 123/90.17 |
| 8,201,529 | B2 * | 6/2012 | Yamaguchi et al. | 123/90.17 |
| 2001/0039932 | A1 * | 11/2001 | Sekiya et al. | 123/90.17 |
| 2001/0052330 | A1 * | 12/2001 | Takenaka et al. | 123/90.17 |
| 2001/0054406 | A1 * | 12/2001 | Okada et al. | 123/90.17 |
| 2002/0078913 | A1 | 6/2002 | Fukuhara et al. | |

(Continued)

FOREIGN PATENT DOCUMENTS

| | | |
|---|---|---|
| JP | 11-081926 | 3/1999 |
| JP | 2000-230511 | 8/2000 |

(Continued)

OTHER PUBLICATIONS

Japanese Office Action dated Sep. 20, 2011, issued in corresponding Japanese Application No. 2009-238485 with English Translation.

(Continued)

*Primary Examiner* — Thomas Denion
*Assistant Examiner* — Steven D Shipe
(74) *Attorney, Agent, or Firm* — Nixon & Vanderhye P.C.

(57) ABSTRACT

A valve timing adjuster for an internal combustion engine adjusts valve timing. The valve timing adjuster includes a housing, a vane rotor, a regulation device, a fluid route, and an opening/closing control device. The regulation device regulates a rotational phase of the vane rotor relative to the housing to a regulation position located between a full advance position and a full retard position. The fluid route is communicated with a specific chamber that is at least one of an advance chamber and a retard chamber. The fluid route extends via a radially inner part to be communicated with atmosphere. The radially inner part is located radially between the specific chamber and a rotation center. The opening/closing control device opens and closes the fluid route.

8 Claims, 12 Drawing Sheets

(56) References Cited

U.S. PATENT DOCUMENTS

| | | | | |
|---|---|---|---|---|
| 2002/0139332 | A1 | 10/2002 | Takenaka | |
| 2002/0139334 | A1* | 10/2002 | Kinugawa | 123/90.17 |
| 2006/0266318 | A1* | 11/2006 | Suga et al. | 123/90.17 |
| 2008/0017145 | A1 | 1/2008 | Sato | |
| 2008/0047515 | A1 | 2/2008 | Noguchi | |
| 2009/0071424 | A1* | 3/2009 | Takenaka et al. | 123/90.15 |
| 2009/0250028 | A1* | 10/2009 | Fujiyoshi et al. | 123/90.17 |
| 2009/0260591 | A1* | 10/2009 | Yamaguchi et al. | 123/90.17 |
| 2010/0050966 | A1* | 3/2010 | Ozawa et al. | 123/90.17 |
| 2010/0212615 | A1* | 8/2010 | Suzuki et al. | 123/90.17 |
| 2010/0251980 | A1* | 10/2010 | Ushida et al. | 123/90.17 |
| 2010/0269772 | A1* | 10/2010 | Takemura et al. | 123/90.17 |
| 2010/0313835 | A1* | 12/2010 | Yamaguchi et al. | 123/90.15 |
| 2011/0088645 | A1* | 4/2011 | Yamaguchi et al. | 123/90.17 |
| 2011/0162601 | A1* | 7/2011 | Fujiyoshi et al. | 123/90.15 |
| 2011/0214634 | A1* | 9/2011 | Yamaguchi et al. | 123/90.17 |
| 2012/0152190 | A1* | 6/2012 | Kobayashi et al. | 123/90.15 |

FOREIGN PATENT DOCUMENTS

| | | |
|---|---|---|
| JP | 2000-274216 | 10/2000 |
| JP | 2000-345816 | 12/2000 |
| JP | 2001-193421 | 7/2001 |
| JP | 2002-256826 | 9/2002 |
| JP | 2003-314220 | 11/2003 |
| JP | 2005-083363 | 3/2005 |
| JP | 2008-050970 | 3/2008 |
| JP | 2002-357105 | 12/2012 |

OTHER PUBLICATIONS

Korean Office Action dated Apr. 30 2012, issued in corresponding Korean Application No. 10-2010-0100169 with English Translation.

Japanese Office Action issued for corresponding Japanese Patent Application No. 2011-250814, dated Mar. 5, 2013.

Chinese Office Action issued for corresponding Chinese Patent Application No. 201010511716.X, dated Apr. 16, 2013 (with English Translation) 15 pages.

* cited by examiner

VALVE TIMING ADJUSTER

CROSS REFERENCE TO RELATED APPLICATION

This application is based on and incorporates herein by reference Japanese Patent Application No. 2009-238485 filed on Oct. 15, 2009.

BACKGROUND OF THE INVENTION

1. Field of the Invention

The present invention relates to a valve timing adjuster for controlling valve timing of a valve that is opened and closed by a camshaft through torque transmitted from a crankshaft in an internal combustion engine.

2. Description of Related Art

A conventional valve timing adjuster is known to include a housing and a vane rotor and is known to adjust valve timing using hydraulic oil supplied from a supply source, such as a pump. For example, in an apparatus of JP-A-2002-357105 corresponding to US2002/0139332, a vane rotor in the housing has vanes that define advance chambers and retard chambers arranged one after another in a rotational direction (circumferential direction), and the apparatus adjusts valve timing by changing the rotational phase of the vane rotor relative to the housing in an advance direction and in a retard direction by supplying working fluid to the corresponding chambers.

The apparatus of JP-A-2002-357105 is designed such that the rotational phase is to be regulated to a regulation position located between a full advance position and a full retard position by bringing a regulation member, which is supported by the vane rotor, into engagement with the vane rotor. In the configuration above, the regulating of the rotational phase to the regulation position at the stopping of the internal combustion engine makes it possible to maintain the rotational phase to the regulation position at the starting of the internal combustion engine in the next operation, and thereby it is possible to achieve the engine startability.

In the apparatus of JP-A-2002-357105, in a case, where the internal combustion engine under operation instantly stops due to the occurrence of abnormality, the internal combustion engine may stop before the rotational phase is regulated to a regulation position. If cranking of the internal combustion engine starts after the above abnormal stop of the engine in a condition, where the rotational phase is located at a position different from the regulation position, the amount of intake air to the engine may not be appropriate, and thereby the engine startability may deteriorate disadvantageously.

The inventors have intensively studied a technique that shifts the rotational phase back to the regulation position by using variable torque (torque reversal) that is applied from the camshaft to the vane rotor at the time of engine start through cranking of the internal combustion engine. As a result, the inventors have found that the rotational phase is less likely to be shifted back to the regulation position under a low-temperature environment. More specifically, under the low-temperature environment, the degree of viscosity of working fluid is increased, and thereby the introduction of the working fluid into each chamber may be delayed. Thus, the variable torque (torque reversal) enlarges the volume of the advance chamber or the retard chamber at the time of starting the internal combustion engine, and thereby negative pressure may be disadvantageously generated for disturbing the movement of the vane rotor. As a result, the rotational phase becomes less likely to be shifted back to the regulation position under the low-temperature environment.

SUMMARY OF THE INVENTION

The present invention is made in view of the above disadvantages. Thus, it is an objective of the present invention to address at feast one of the above disadvantages.

To achieve the objective of the present invention, there is provided an valve timing adjuster for an internal combustion engine having a crankshaft and a camshaft, wherein the valve timing adjuster adjusts valve timing of a valve, which is opened and closed by the camshaft through torque transmission from the crankshaft, wherein the valve timing adjuster uses working fluid supplied from a supply source in order to adjust the valve timing. The valve timing adjuster includes a housing, a vane rotor, regulation means, a fluid route, and opening/closing control means. The housing is rotatable synchronously with the crankshaft around a rotation center. The vane rotor is rotatable synchronously with the camshaft around the rotation center. The vane rotor has a vane that divides an internal space of the housing into an advance chamber and a retard chamber arranged one after another in a rotational direction of the vane rotor. When working fluid is introduced into the advance chamber, a rotational phase of the vane rotor relative to the housing is shifted in an advance direction. When working fluid is introduced into the retard chamber, the rotational phase is shifted in a retard direction. The regulation means regulates the rotational phase to a regulation position located between a full advance position and a full retard position. The fluid route is communicated with a specific chamber that is at least one of the advance chamber and the retard chamber. The fluid route extends via a radially inner part to be communicated with atmosphere. The radially inner part is located radially between the specific chamber and the rotation center. The opening/closing control means opens and closes the fluid route.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF PREFERRED EMBODIMENTS

Multiple embodiments of the present invention will be described with reference to accompanying drawings. Components of each of the embodiments, which are similar to each other, are indicated by the same numerals, and the redundant explanation will be omitted.

First Embodiment

Figure 1:
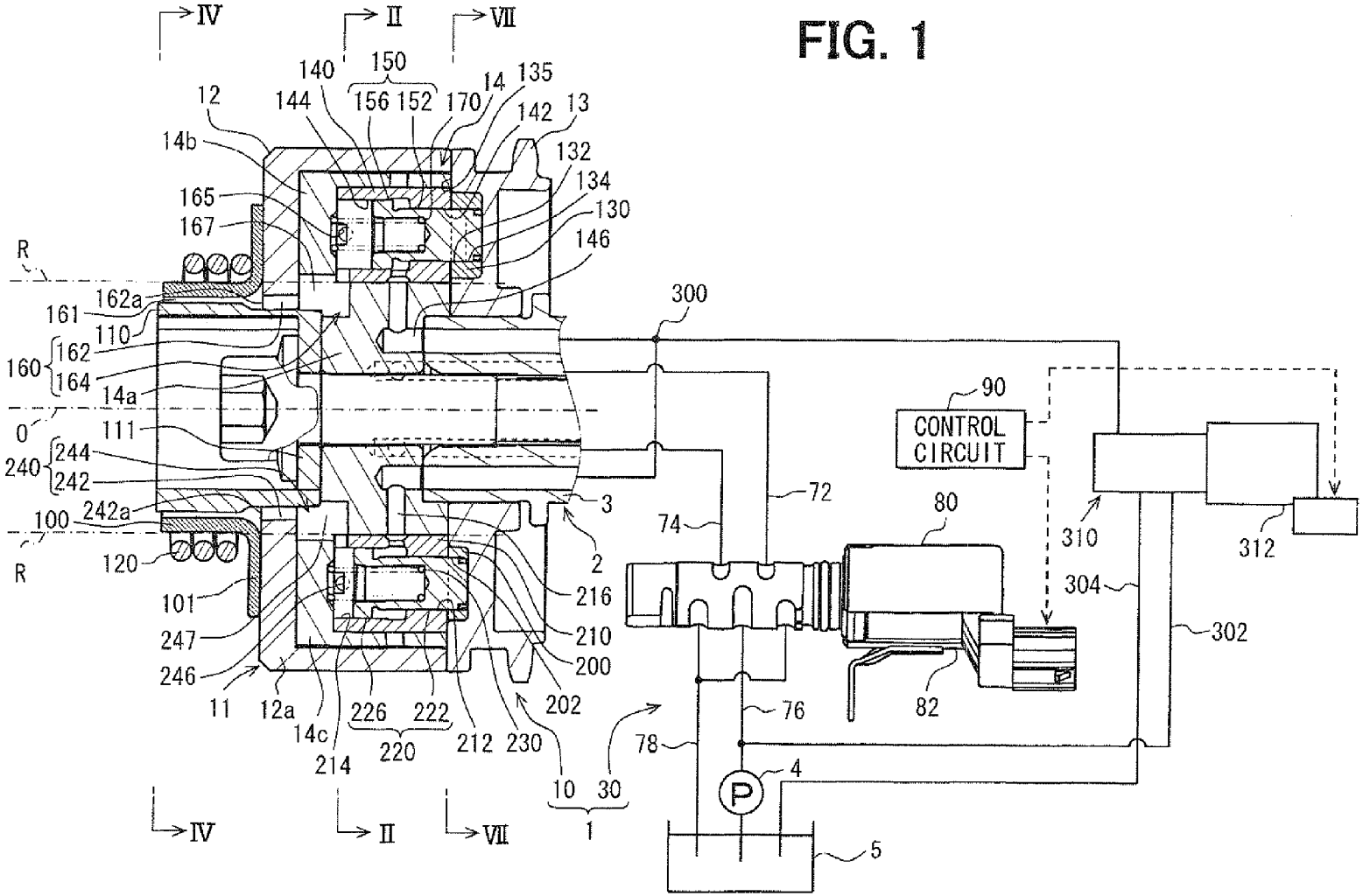
FIG. 1 is a configuration diagram illustrating a valve timing adjuster according to the first embodiment of the present invention and is a cross-sectional view take along line I-I in FIG. 2.

FIG. 1 shows an example, in which a valve timing adjuster 1 of the first embodiment of the present invention is used for an internal combustion engine 2 of a vehicle. The valve timing adjuster 1 uses hydraulic oil supplied by a pump 4 in order to adjust valve timing of an intake valve that is opened and closed by a camshaft 3 of the internal combustion engine 2. The pump 4 serves as a "supply source", and the intake valve serves as a "valve". Also, hydraulic oil serves as "working fluid".

(Basic Configuration)

A basic configuration of the valve timing adjuster 1 will be described below. The valve timing adjuster 1 includes a drive unit 10 and a control unit 30. The drive unit 10 is provided to a transmission system that transmits engine torque to the camshaft 3 from a crankshaft (not shown) of the internal combustion engine 2. The control unit 30 controls the operation of the drive unit 10.

(Drive Unit)

Figure 2:
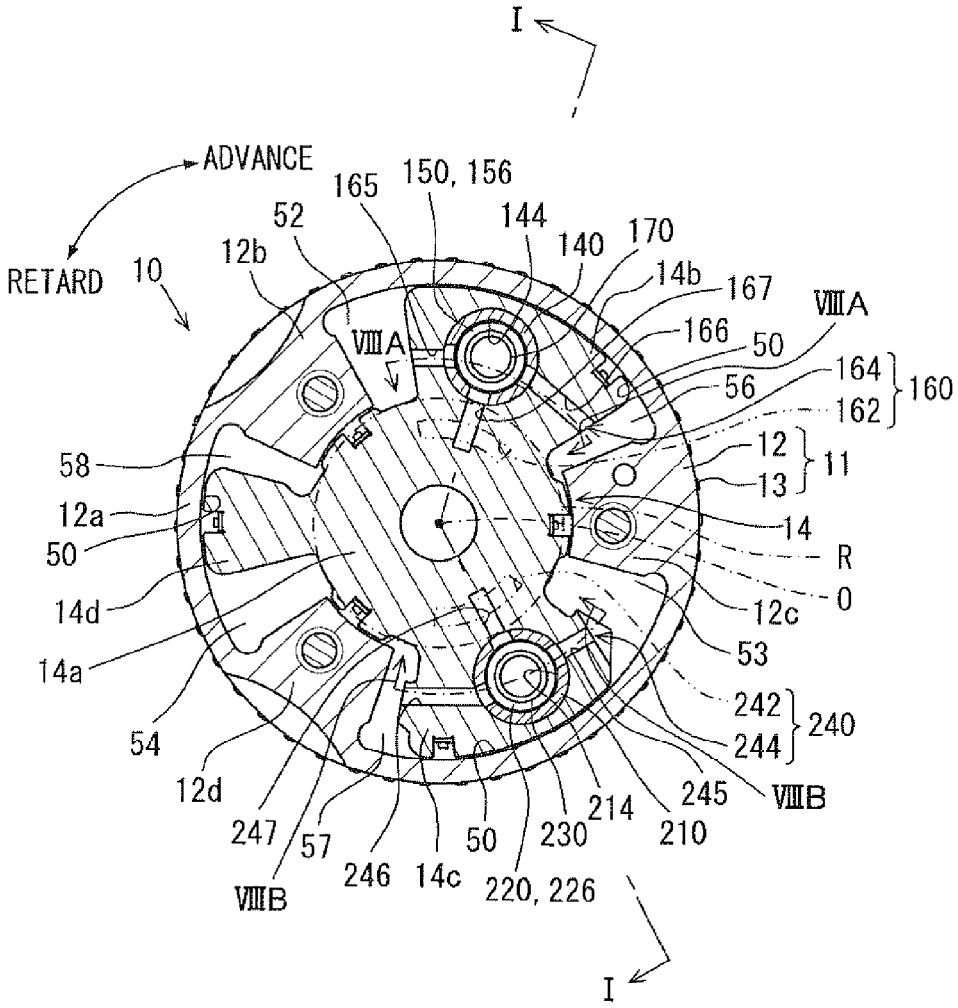
FIG. 2 is a cross-sectional view taken along line II-II in FIG. 1.

As shown in FIGS. 1 and 2, the drive unit 10 includes a housing 11 and a vane rotor 14, and the housing 11 has a shoe member 12 and a sprocket member 13.

The shoe member 12 is made of metal and has a tubular portion 12*a* and multiple shoes 12*b*, 12*c*, 12*d*. The tubular portion 12*a* has a hollow cylindrical shape with a bottom. The shoes 12*b* to 12*d* are arranged at the tubular portion 12*a* at equal intervals one after another in a rotational direction and project radially inwardly from the tubular portion 12*a*. Each of the shoes 12*b* to 12*d* has a radially inner surface that has an arcuate shape taken along a plane perpendicular to an rotational axis of the vane rotor 14. The radially inner surfaces of the shoes 12*b* to 12*d* slide on an outer peripheral surface of a hub portion 14*a* of the vane rotor 14. Adjacent ones of the shoes 12*b* to 12*d* in the rotational direction define therebetween a receiving chamber 50.

The sprocket member 13 is made of metal to have an annular plate shape and is fixed coaxially to the opening end of the tubular portion 12*a* of the shoe member 12. The sprocket member 13 is drivingly linked to the crankshaft through a timing chain (not shown). As a result, during the operation of the internal combustion engine 2, transmission of the engine torque from the crankshaft to the sprocket member 13 causes the housing 11 to rotate synchronously with the crankshaft about a rotation center O. In the present embodiment, the housing 11 rotates in a clockwise direction in FIG. 2.

As shown in FIGS. 1 and 2, the vane rotor 14 is made of metal and is received coaxially within the housing 11. The vane rotor 14 has opposite axial end portions that slide on the annular bottom wall of the tubular portion 12*a* and the sprocket member 13. The vane rotor 14 has the hub portion 14*a* and multiple vanes 14*b*, 14*c*, 14*d*. The hub portion 14*a* has a column shape.

The hub portion 14*a* is fixed coaxially to the camshaft 3. As a result, the vane rotor 14 is rotatable synchronously with the camshaft 3 about the rotation center O, about which the housing 11 also rotates. Simultaneously, the vane rotor 14 is rotatable relative to the housing 11. In the present embodiment, the vane rotor 14 rotates in the clockwise direction in FIG. 2.

The vanes 14*b*, 14*c*, 14*d* are arranged at regular intervals from one after another in the circumferential direction at the hub portion 14*a* and project radially outwardly from the hub portion 14*a*. Each of the vanes 14*b*, 14*c*, 14*d* is received in the corresponding receiving chamber 50. Each of the vanes 14*b*, 14*c*, 14*d* has a radially outer surface having an arcuate shape taken along the plane perpendicular to the rotational axis of the vane rotor 14 as shown in FIG. 2. The radially outer surfaces of the vanes 14*b*, 14*c*, 14*d* slide on an inner peripheral surface of the tubular portion 12*a*. Each of the vanes 14*b*, 14*c*, 14*d* divides the corresponding receiving chamber 50 of the housing 11 into a corresponding advance chamber 52, 53, 54 and a corresponding retard chamber 56, 57, 58 that are arranged in the circumferential direction.

Specifically, the advance chamber 52 is defined between the shoe 12*b* and the vane 14*b*, the advance chamber 53 is defined between the shoe 12*c* and the vane 14*c*, and the advance chamber 54 is defined between the shoe 12*d* and the vane 14*d*. Also, the retard chamber 56 is defined between the shoe 12*c* and the vane 14*b*, the retard chamber 57 is defined between the shoe 12*d* and the vane 14*c*, and the retard chamber 58 is defined between the shoe 12*b* and the vane 14*d*. In FIGS. 1 and 2, a dashed and single-dotted line R schematically indicates an imaginary cylindrical surface of the advance chambers 52, 53, 54 and the retard chambers 56, 57, 58 about a center axis of a rotation center O of the housing 11 and the vane rotor 14. More specifically, the imaginary cylindrical surface includes a radially-innermost peripheral edge of the advance chambers 52, 53, 54 and the retard chambers 56, 57, 58.

In the above drive unit 10, a rotational phase of the vane rotor 14 relative to the housing 11 is changed in an advance direction by introducing hydraulic oil into the advance chambers 52, 53, 54 and by draining hydraulic oil from the retard chambers 56, 57, 58. Accordingly, the valve timing is advanced. In contrast, the rotational phase is changed in a retard direction by introducing hydraulic oil into the retard chambers 56, 57, 58 and also by draining hydraulic oil from the advance chambers 52, 53, 54. Accordingly, the valve timing is retarded.

(Control Unit)

In the control unit 30 shown in FIG. 1, an advance passage 72 extends through the camshaft 3 and a bearing (not shown) that journals the camshaft 3. The advance passage 72 is communicated with the advance chambers 52, 53, 54 (see FIG. 2) regardless of the change of the rotational phase. Also, a retard passage 74 extends through the camshaft 3 and the bearing, and is communicated with the retard chambers 56, 57, 58 (see FIG. 2) regardless of the change of the rotational phase.

A supply passage 76 is communicated with a discharge port of the pump 4. Hydraulic oil is suctioned from an oil pan 5 into an inlet port of the pump 4, and the suctioned hydraulic oil is discharged through the discharge port of the pump 4. The pump 4 of the present embodiment is a mechanical pump driven by the crankshaft to discharge hydraulic oil to the supply passage 76 during the operation of the internal combustion engine 2. The operation of the internal combustion engine 2 includes the starting of the engine 2. Also, a drain passage 78 is provided to drain hydraulic oil to the oil pan 5.

A phase control valve 80 is mechanically connected to the advance passage 72, the retard passage 74, the supply passage 76, and the drain passage 78. The phase control valve 80 has a solenoid 82 and operates based on the energization to the solenoid 82 such that the phase control valve 80 switches communication state of (a) the advance passage 72 and the retard passage 74 with (b) the supply passage 76 and the drain passage 78.

A control circuit 90 is mainly made of a microcomputer, and is electrically connected with the solenoid 82 of the phase control valve 80. The control circuit 90 controls energization to the solenoid 82 and also controls the operation of the internal combustion engine.

In the above control unit 30, during the operation of the internal combustion engine 2, the phase control valve 80 operates in accordance with the energization to the solenoid 82 controlled by the control circuit 90 in order to change the communication state between (a) the advance passage 72 and the retard passage 74 and (b) the supply passage 76 and the drain passage 78. In the above, when the phase control valve 80 communicates the advance passage 72 with the supply passage 76 and communicates the retard passage 74 with the drain passage 78, hydraulic oil from the pump 4 is introduced to the advance chambers 52, 53, 54 through the passages 76, 72. Also, hydraulic oil in the retard chambers 56, 57, 58 is drained to the oil pan 5 through passages 74, 78. As a result, the valve timing is advanced.

In contrast, when the phase control valve 80 communicates the retard passage 74 with the supply passage 76 and communicates the advance passage 72 with the drain passage 78, hydraulic oil from the pump 4 is introduced into the retard chambers 56, 57, 58 through passages 76, 74, and hydraulic oil in the advance chambers 52, 53, 54 is drained to the oil pan 5 through the passages 72, 78. Accordingly, the valve timing is retarded.

(Detailed Configuration)

A configuration of the valve timing adjuster 1 will be detailed below.

(Operational Structure of Torque Variation)

Figure 3:
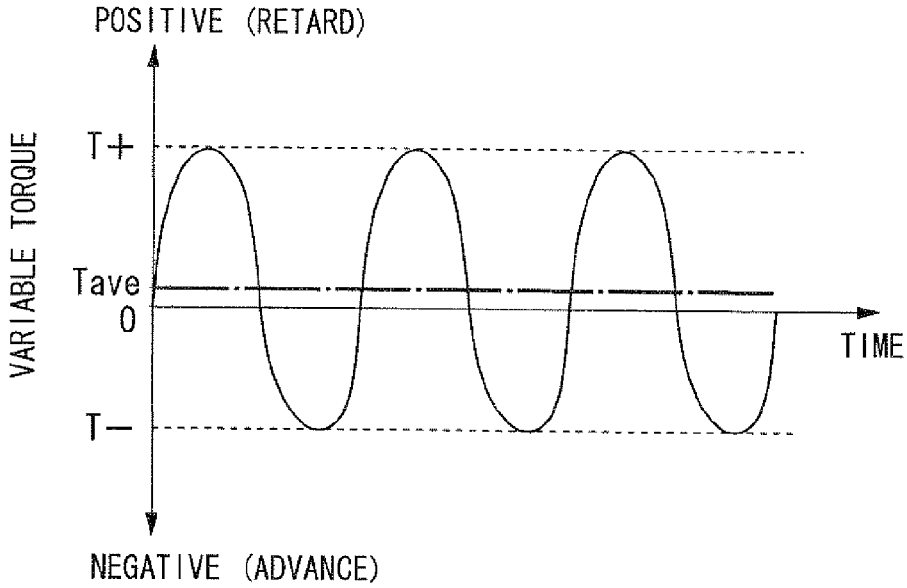
FIG. 3 is a schematic diagram for explaining variation of torque that is received by a drive unit shown in FIG. 1.

As shown in FIG. 1, the vane rotor 14 is connected with the camshaft 3 in the drive unit 10. As a result, the force caused by the torque variations (or torque reversals) is applied to the vane rotor 14 due to a spring reaction force of a valve spring of the intake valve that is opened and closed by the camshaft 3 during the operation of the internal combustion engine 2. As shown in FIG. 3, the torque alternately changes or torque variations alternately change between a negative torque and a positive torque. When the negative torque is applied to the vane rotor 14 through the camshaft 3, the rotational phase of the vane rotor 14 relative to the housing 11 is biased in the advance direction. In contrast, when the positive torque is applied to the vane rotor 14 through the camshaft 3, the rotational phase is biased in the retard direction. Specifically, the torque variations of the present embodiment are likely to have a peak torque T+ of the positive torque greater than an absolute value of a peak torque T− of the negative torque due to friction between the camshaft 3 and the bearing. As a result, the torque variations have an average torque $T_{ave}$ that biases the vane rotor 14 toward the positive torque. In other words, the average torque $T_{ave}$ biases the rotational phase of the vane rotor 14 relative to the housing 11 in the retard direction in average. Thus, the vane rotor 14 receives torque from the camshaft 3 in the retard direction in average.

(Urging Configuration)

Figure 4:
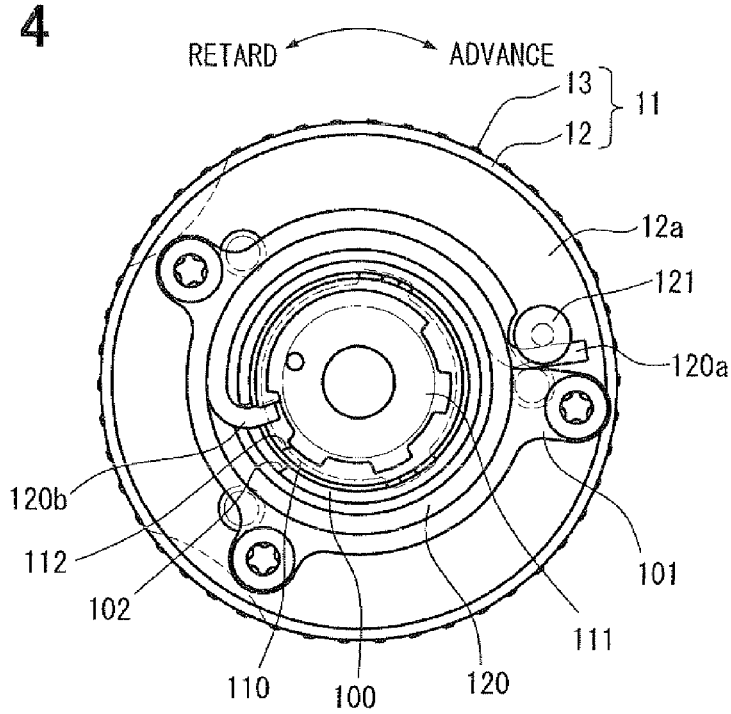
FIG. 4 is a view observed in direction IV-IV in FIG. 1.

As shown in FIGS. 1 and 4, the housing 11 has a housing bush 100 that is made of a metal into a hollow cylindrical shape. The housing bush 100 has a flange wall 101 that is coaxially fixed to a side of the bottom wall of the tubular portion 12*a*, which side is positioned remote from the sprocket member 13. The housing bush 100 has an end portion positioned opposite from the flange wall 101 in the longitudinal direction of the housing bush 100. As shown in FIG. 4, the end portion defines an arcuate housing groove 102, which extends in the circumferential direction, and which is made by cutting part of the end portion in a radial direction.

As shown in FIGS. 1 and 4, the vane rotor 14 has a rotor bush 110 that is made of metal and is a hollow cylinder having a bottom wall 111. The bottom wall 111 of the rotor bush 110 is coaxially fixed to a side of the hub portion 14*a* of the vane rotor 14, which side is remote from the sprocket member 13. The rotor bush 110 has a diameter smaller than a diameter of the housing bush 100. The rotor bush 110 is located at a position radially inward of the housing bush 100 and also radially inward of the bottom wall of the tubular portion 12*a*. Also, the rotor bush 110 is rotatable relative to the housing bush 100 and the tubular portion 12*a*. The rotor bush 110 has an end portion positioned opposite from the bottom wall 111 in the longitudinal direction of the rotor bush 110. As shown in FIG. 4, the end portion defines therein an arcuate rotor groove 112, which extends in the circumferential direction, and which is made by cutting part of the end portion in the radial direction.

An urging member 120 is provided coaxially at a position radially outward of the housing bush 100 and is made of a metal helical torsion spring. The tubular portion 12*a* has an engagement pin 121 that is fixed thereto. The urging member 120 has one end portion 120*a* that is engaged with the engagement pin 121 of the tubular portion 12*a*. The urging member 120 has the other end portion 120*b* that extends through the housing groove 102 and the rotor groove 112 in a radially inward direction. The other end portion 120*b* is loosely fitted with the housing groove 102 and the rotor groove 112.

Figure 5:
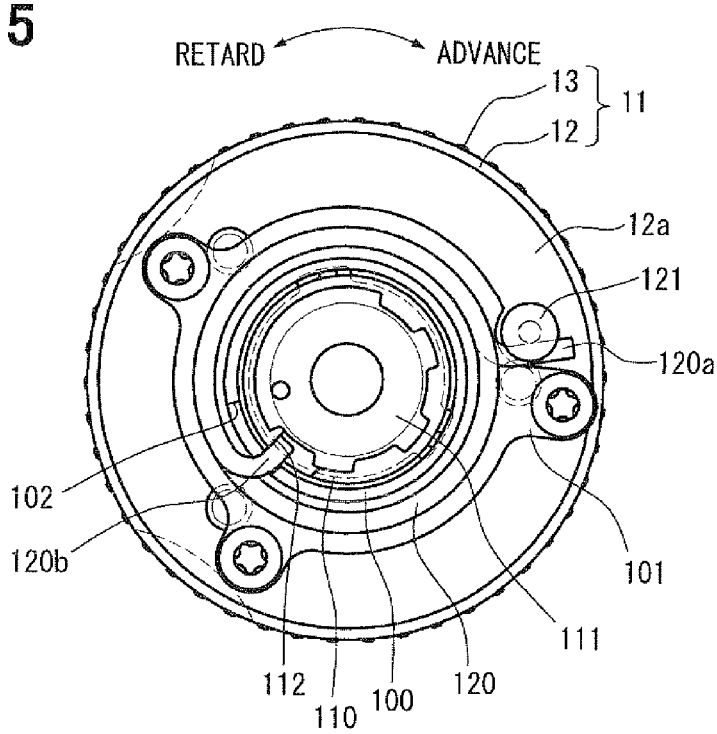
FIG. 5 is a view illustrating an operational state different from that in FIG. 4.

In the present embodiment, when the rotational phase is positioned between (a) a full retard position shown in FIG. 5 and (b) a certain lock position shown in FIG. 4, the other end portion 120*b* of the urging member 120 is engaged with an advance end of the rotor groove 112. In contrast, the other end portion 120*b* of the urging member 120 is not engaged with the housing groove 102 at the above state. As a result, during the operation of the internal combustion engine 2, the urging member 120 applies restoring force, which is generated when twisted, to the rotor groove 112 in the advance direction against the average torque $T_{ave}$ of the torque variations. In the preset embodiment, the restoring force of the urging member 120 is set greater than the average torque $T_{ave}$ of the torque variations. As a result, the rotor bush 110 is urged in the advance direction of the rotational phase together with the vane rotor 14.

Figure 6:
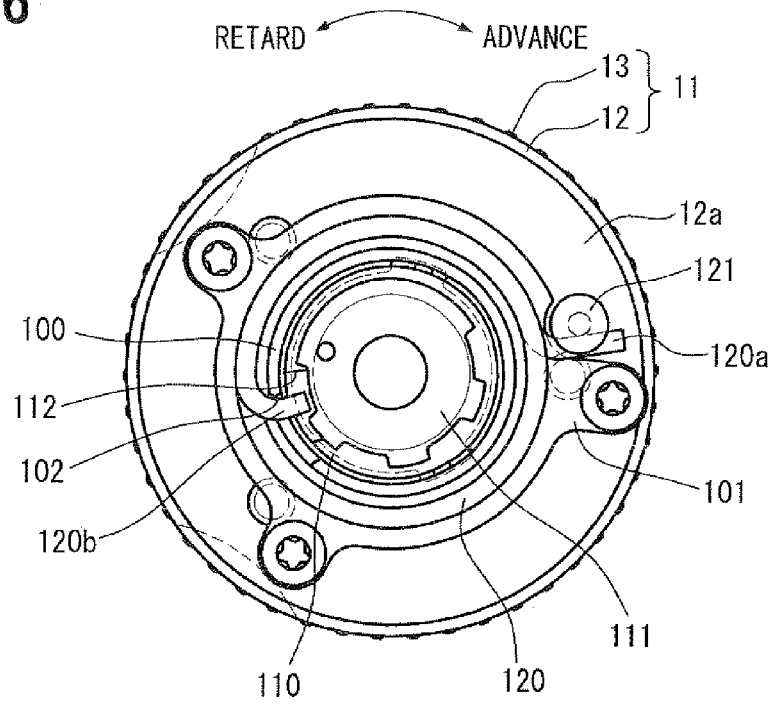
FIG. 6 is a view illustrating an operational state different from those in FIGS. 4 and 5.

In contrast, when the rotational phase is positioned between (a) the lock position shown in FIG. 4 and (b) a full advance position shown in FIG. 6, the other end portion 120*b* of the urging member 120 is engaged with an advance end of the housing groove 102. Thus, the other end portion 120*b* of the urging member 120 is not engaged with the rotor groove 112 in the above state. As a result, the urging member 120 exerts the restoring force only to the housing bush 100.

Thus, in the present embodiment, the urging member 120 urges the vane rotor 14 in the advance direction when the rotational phase of the vane rotor 14 is positioned on a retard side of the lock position or is further retarded from the lock position that serves as a regulation position. However, the urging member 120 does not urge the vane rotor 14 in the advance direction when the rotational phase of the vane rotor 14 is on an advance side of the lock position or is further advanced from the lock position. It should be noted that in the internal combustion engine 2 of the present embodiment, for which the valve timing adjuster 1 is used, the rotational phase is regulated to the regulation position in order to achieve effective startability when the engine 2 is started. The regulation position is defined as a position somewhere in a range between an intermediate position to the full advance position, and the above intermediate position is located between the full retard position and the full advance position. The lock position of the present embodiment is set to the regulation position such that the optimized engine startability is reliably achieved regardless of the change of the ambient temperature. Due to the above configuration, it is possible to prevent the excessive decrease of the intake air amount due to the delay of closing the intake valve at the engine start by cranking the engine 2.

(First Regulation Structure)

Figure 7:
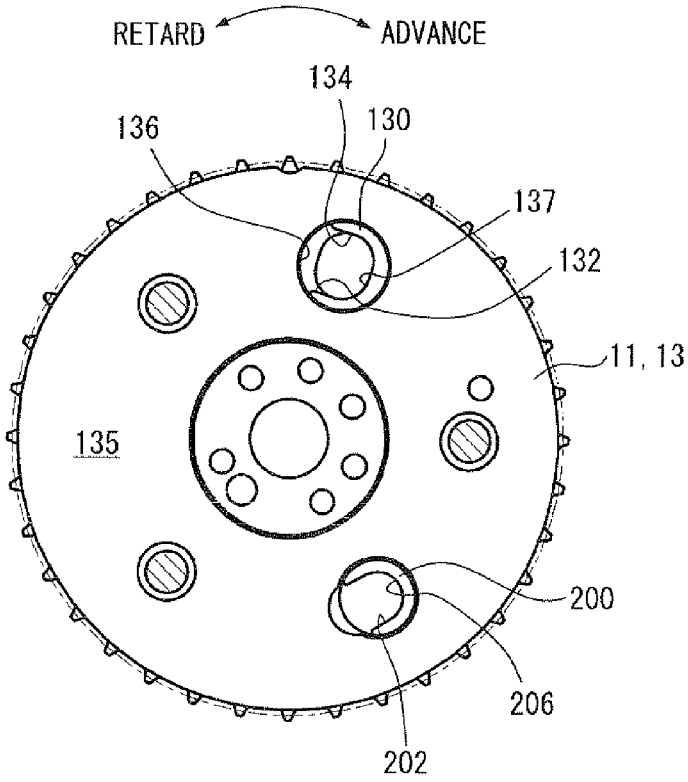
FIG. 7 is a cross-sectional view taken along line VII-VII in FIG. 1.

A guide 130 is made of metal and is embedded in the sprocket member 13. As shown in FIGS. 1 and 7, the housing 11 define a first regulation recess 132 and a lock recess 134 by using the guide 130. The first regulation recess 132 opens at an inner surface 135 of the sprocket member 13, which surface slides on the vane rotor 14. Also, the first regulation recess 132 extends in the rotational direction (circumferential direction) of the housing 11. The first regulation recess 132 has a pair of first regulation stoppers 136, 137 at opposite closed end portions of the recess 132 in the circumferential direction. The lock recess 134 is a hollow tube with a bottom and extends in an axial direction of the camshaft 3. The lock recess 134 is a tubular hole with a bottom and extends in a longitudinal direction of the camshaft 3. The lock recess 134 opens at the bottom surface of the first regulation recess 132 at an advance end of the first regulation recess 132.

As shown in FIGS. 1 and 2, the vane rotor 14 has a metal sleeve 140 that is embedded in the vane 14*b* of the vane rotor 14. The sleeve 140 has an inner peripheral surface that has a stepped tubular surface shape, and the inner peripheral surface of the sleeve 140 defines a first small-diameter hole 142 and a first large-diameter hole 144, both of which extend in a longitudinal direction of the hub portion 14*a*. The first small-diameter hole 142 has a diameter smaller than a diameter of the first large-diameter hole 144 and is positioned on a side of the first large-diameter hole 144 adjacent to the sprocket member 13. The first small-diameter hole 142 opens to the inner surface 135 of the sprocket member 13. Accordingly, the first small-diameter hole 142 is opposed to the first regulation recess 132, which extends in the circumferential direction (rotational direction) of the vane rotor 14, when the rotational phase is within a certain rotational phase range. The first large-diameter hole 144 is communicated with a first regulation passage 146 that extends through the sleeve 140 and the vane rotor 14.

The vane rotor 14 supports a first regulation member 150 made of metal by using the sleeve 140 such that the first regulation member 150 extends in the longitudinal direction of the hub portion 14*a*. The first regulation member 150 has a stepped shape as shown in FIG. 1 such that the first regulation member 150 includes a main body portion 152 and a force receiver 156. The main body portion 152 is received within the first small-diameter hole 142 and is reciprocably displaceable in the longitudinal direction. The force receiver 156 is received within the first large-diameter hole 144 and is reciprocably displaceable in the longitudinal direction. The force receiver 156 has an end surface facing toward the sprocket member 13, and the end surface of the force receiver 156 receives pressure of hydraulic oil that is introduced into the first large-diameter hole 144 through the first regulation passage 146. As a result, the application of the pressure generates a first regulation driving force that drives the first regulation member 150 in a direction away from the sprocket member 13.

As shown in FIGS. 1 and 2, a first regulation resilient member 170, which is made of a metal compression coil spring, is received within the sleeve 140 such that the first regulation resilient member 170 extends in the longitudinal direction of the hub portion 14*a*. The first regulation resilient member 170 is interposed between the bottom part of the first large-diameter hole 144 and the first regulation member 150. The first regulation resilient member 170 applies restoring force, which is generated when compressed between the first large-diameter hole 144 and the first regulation member 150, to the first regulation member 150, and thereby the first regulation resilient member 170 urges the first regulation member 150 toward the sprocket member 13.

Figures 8A, 8B, 8C, 8D, 8E, 8F, 8G, 8H, 8I, 8J, 8K, 8L:
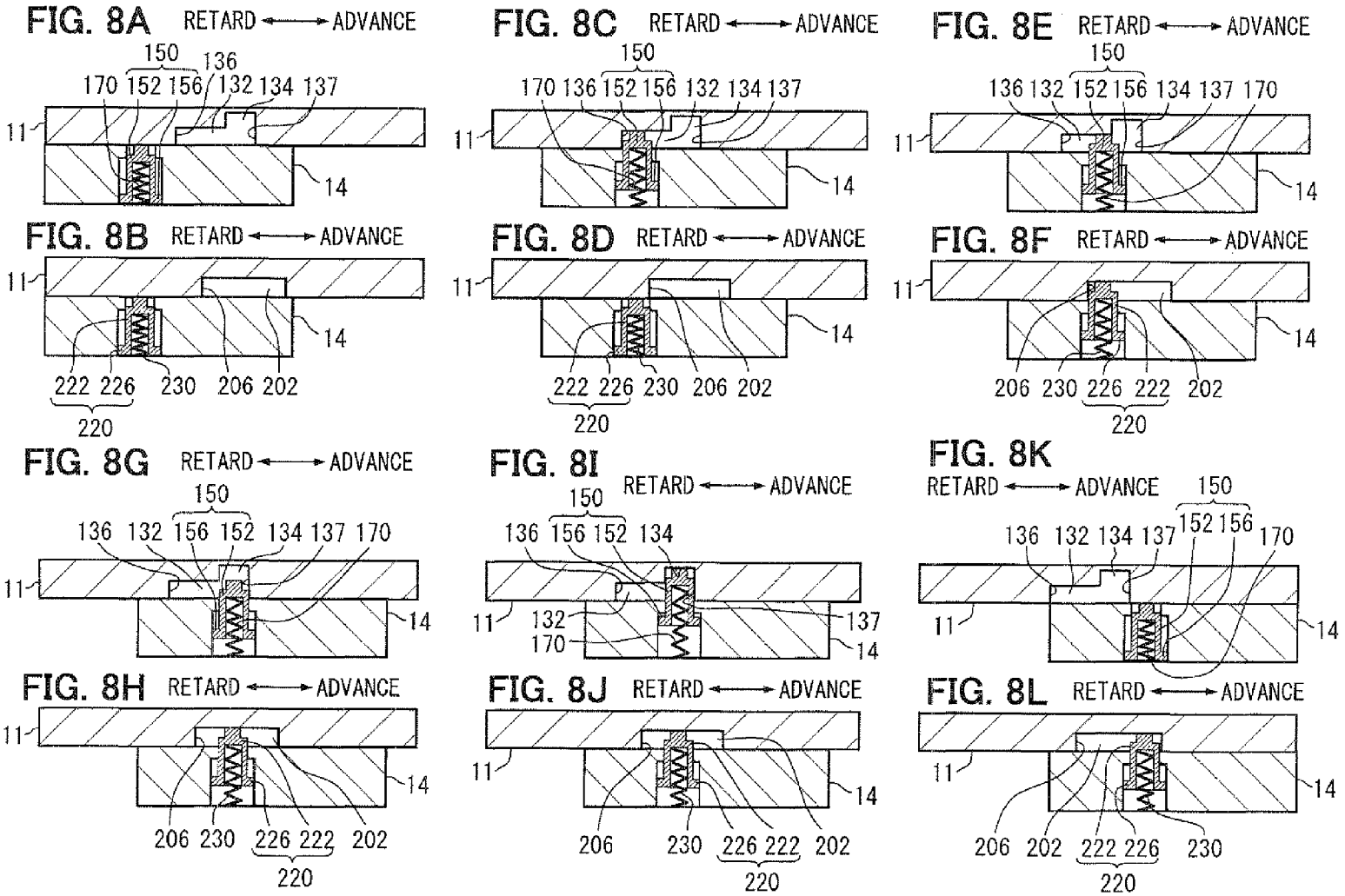
FIGS. 8A and 8B are cross section schematic diagrams of the valve timing adjuster taken along lines VIIIA-VIIIA and VIIIB-VIIIB of FIG. 2, respectively, when a rotational phase corresponds to a full retard position.
FIGS. 8C and 8D are cross section schematic diagrams of the valve timing adjuster when the rotational phase corresponds to a first regulation position.
FIGS. 8E and 8F are cross section schematic diagrams of the valve timing adjuster when the rotational phase corresponds to a second regulation position.
FIGS. 8G and 8H are cross section schematic diagrams of the valve timing adjuster when the rotational phase corresponds to a lock position.
FIGS. 8I and 8J are cross section schematic diagrams of the valve timing adjuster when the rotational phase corresponds to the lock position.
FIGS. 8K and 8L are cross section schematic diagrams of the valve timing adjuster when the rotational phase corresponds to a full advance position.

Due to the above configuration, the main body portion 152 of the first regulation member 150 is inserted into the first regulation recess 132 as shown in FIGS. 8C to 8L. Thus, the main body portion 152 is movable within the first regulation recess 132 and is engageable with each of the first regulation stoppers 136, 137. As shown in FIG. 8C, when the main body portion 152 is displaced to be positioned within the first regulation recess 132 and is engaged with the first regulation stopper 136 that is positioned on the retard end of the first regulation recess 132, the first regulation member 150 prevents the rotational phase from changing from a first regulation position further in the retard direction. More specifically, the first regulation position is a retard end position within an adjustable range of the regulation position. In contrast, as shown in FIG. 8G, when the main body portion 152 positioned within the first regulation recess 132 is engaged with the first regulation stopper 137 located on the advance end of the first regulation recess 132, the first regulation member 150 prevents the rotational phase from changing from the lock position further in the advance direction. The lock position is located within the adjustable range of the regulation position.

Furthermore, when the main body portion 152 of the first regulation member 150 is inserted into the lock recess 134 via the first regulation recess 132 as shown in FIG. 8I, the main body portion 152 is coaxially fitted within the lock recess 134 to lock the rotational phase. As a result, when the main body portion 152 that is fitted within the lock recess 134 is engaged with the inner peripheral surface of the lock recess 134, the first regulation member 150 prevents the change of the rotational phase from the lock position both in the advance direction and in the retard direction.

Further, the main body portion 152 of the first regulation member 150 is capable of getting out of both the lock recess 134 and the first regulation recess 132 as schematically shown in FIGS. 8A, 8K, when the main body portion 152 of the first regulation member 150 moves in the longitudinal direction against the restoring force of the first regulation resilient member 170. As a result, it is possible to release the lock and regulation of the rotational phase. As above, it is possible to allow any change of the rotational phase by causing the main body portion 152 to get out of or to be disengaged from the lock recess 134 and the first regulation recess 132.

(First Opening/Closing Structure)

As shown in FIGS. 1, 2, the drive unit 10 has a first fluid route 160. The first fluid route 160 has a first housing passage 162 and a first rotor passage 164.

The first housing passage 162 extends through the bottom wall of the tubular portion 12*a* in the longitudinal direction of the housing 11, and has an arc shape that extends in the rotational direction of the housing 11. In the present embodiment, the first housing passage 162 is formed at an inner periphery of the through hole formed at the bottom wall of the tubular portion 12*a* along the radially outer surface of the rotor bush 110. The first housing passage 162 has an opening end 162*a* that opens at the side of the bottom wall opposite from the vane rotor 14. Due to the above configuration, the opening end 162*a* of the first housing passage 162 is communicated with or open to the atmosphere outside the housing 11 through an annular clearance 161 formed between the rotor bush 110 and the housing bush 100.

The first rotor passage 164 includes communication holes 165, 166, 167 and the first large-diameter hole 144. As shown in FIG. 2, the first advance communication hole 165 extends through the vane 14*b* and the sleeve 140 of the vane rotor 14 to provide communication between the advance chamber 52 and the first large-diameter hole 144. The first retard communication hole 166 extends through the vane 14*b* and the sleeve 140 to provide communication between the retard chamber 56 and the first large-diameter hole 144. The first atmosphere communication hole 167 extends through the vane rotor 14 and the sleeve 140 and opens at a position facing with the first housing passage 162 such that the first atmosphere communication hole 167 provides communication between the first housing passage 162 and the first large-diameter hole 144 regardless of the change of the rotational phase. In the present embodiment, the first fluid route 160 is communicated with the advance chamber 52 and the retard chamber 56 as shown in FIG. 2, for example.

In the first fluid route 160, the first housing passage 162 is communicated with the first atmosphere communication hole 167 of the first rotor passage 164 at a communication part that is formed radially between (a) the advance chamber 52 and the retard chamber 56 and (b) the rotation center O. In other words, the communication part is formed at a position radially inward of the imaginary cylindrical surface R shown in FIGS. 1 and 2. Further in other words, the communication part is formed adjacent to the rotation center O on a side of the advance and retard chambers. Due to the above, the first fluid route 160 travels along a route formed radially between (a) the advance chamber 52 and the retard chamber 56 and (b) the rotation center O. Thus, the first fluid route 160 has a radially inner part located radially between (a) the advance chamber 52 and the retard chamber 56 and (b) the rotation center O. In other words, the radially inner part is located adjacent to the rotation center O on a side of the advance and retard chambers. Also, the first fluid route 160 is open to the atmosphere through the opening end 162*a* formed to the housing 11 at a position radially between (a) the advance chamber 52 and the retard chamber 56 and (b) the rotation center O.

Figure 9:
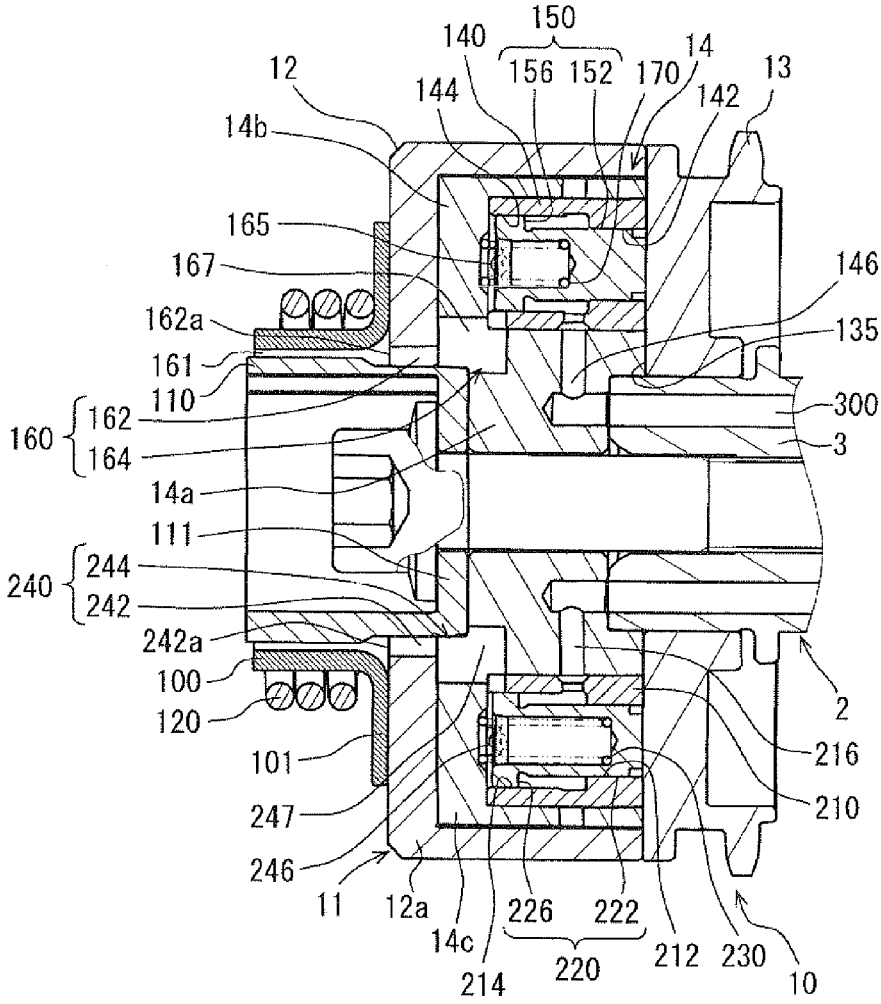
FIG. 9 is a cross-sectional view illustrating an operational state different from that in FIG. 1.

The first fluid route 160 is opened and closed in accordance with a position of the first regulation member 150 that is displaceably received within the first large-diameter hole 144 of the first fluid route 160. As shown in FIG. 1, the first large-diameter hole 144 of the first fluid route 160 is communicated with each of the communication holes 165, 166, 167 when the first regulation member 150 is moved in a range between a fitting position and a contact position. For example, when the first regulation member 150 is located at the fitting position, the first regulation member 150 is fitted into the lock recess 134 through the first regulation recess 132. Also, when the first regulation member 150 is located at the contact position, the first regulation member 150 contacts an inner surface 135 of the sprocket member 13 as shown in FIG. 9. In other words, an opening position for opening the first fluid route 160 corresponds to a position within a range from the fitting position to the contact position. When the first regulation member 150 is located at the opening position, the communication between the advance chamber 52 and the retard chamber 56 is allowed.

Figure 10:
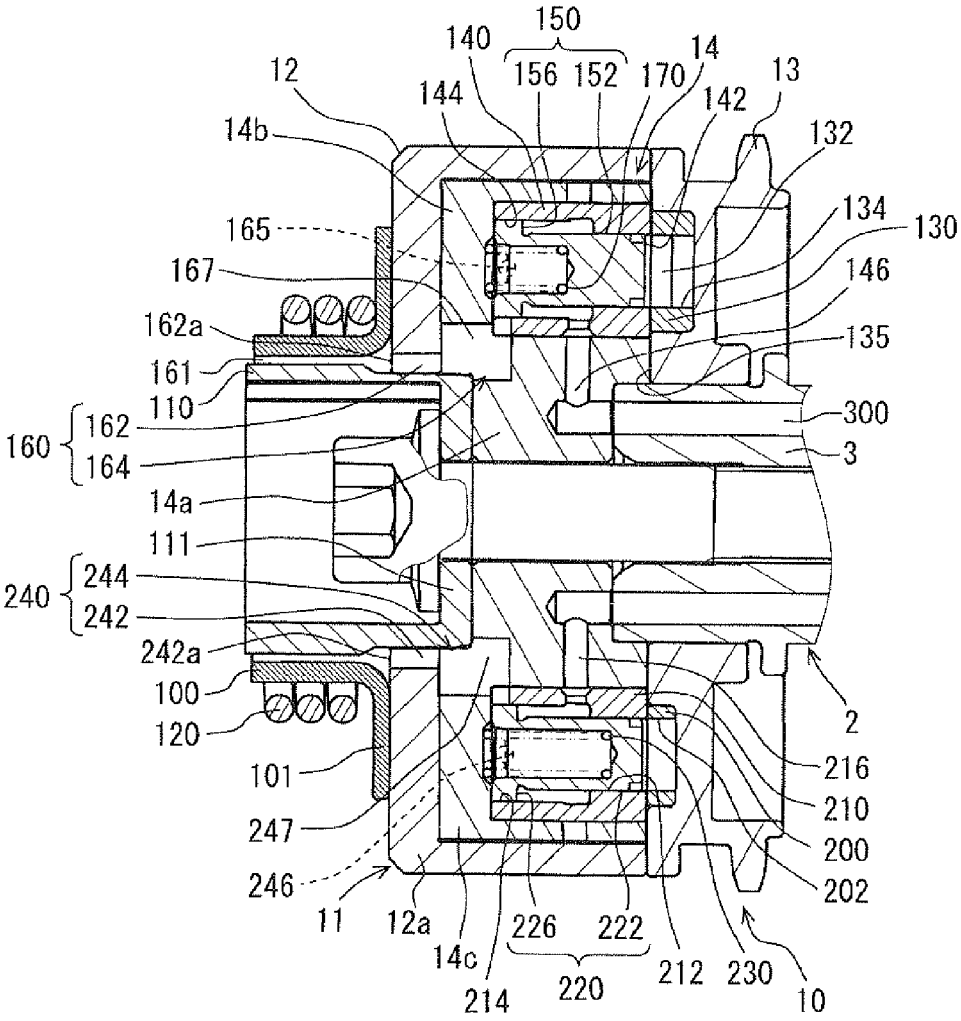
FIG. 10 is a cross-sectional view illustrating an operational state different from those in FIGS. 1 and 9.

In contrast, when the first regulation member 150 is located at a separate position that is spaced away from the inner surface 135 of the sprocket member 13 by a predetermined distance as shown in FIG. 10, the first large-diameter hole 144 of the first fluid route 160 is prevented from being communicated with each of the communication holes 165, 166, 167. In other words, a closed position of the first regulation member 150 for closing the first fluid route 160 corresponds to the above separate position. When the first regulation member 150 is located at the closed position, the communication between the advance chamber 52 and the retard chamber 56 is prohibited.

(Second Regulation Structure)

As shown in FIGS. 1, 7, the housing 11 defines a second regulation recess 202 by using a metal guide 200 embedded in the sprocket member 13. The second regulation recess 202 opens at the inner surface 135 of the sprocket member 13 and extends in the rotational direction (circumferential direction) of the housing 11. The second regulation recess 202 has opposite closed end portions at both extending directions. The second regulation recess 202 has a second regulation stopper 206 formed at a retard one of the end portions of the second regulation recess 202.

As shown in FIGS. 1 and 2, a metal sleeve 210 is embedded in the vane 14*c* of the vane rotor 14. The sleeve 210 has an inner peripheral surface having a stepped cylindrical surface shape. The inner peripheral surface of the sleeve 210 defines a second small-diameter hole 212 and a second large-diameter hole 214, both of which extend in the longitudinal direction of the hub portion 14*a*. The second small-diameter hole 212 has a diameter smaller than a diameter of the second large-diameter hole 214, and is positioned on a side of the second large-diameter hole 214 adjacent to the sprocket member 13. Also, the second small-diameter hole 212 opens to the inner surface 135 of the sprocket member 13. Due to the above configuration, the second small-diameter hole 212 overlaps with the second regulation recess 202, which extends in the circumferential direction of the vane rotor 14, over a predetermined rotational phase range. The second large-diameter hole 214 is communicated with a second regulation passage 216 that extends through the sleeve 210 and the vane rotor 14.

The vane rotor 14 supports a metal second regulation member 220 by the sleeve 210 such that the second regulation member 220 extends in the longitudinal direction of the hub portion 14*a*. The second regulation member 220 has a stepped shape as shown in FIG. 1 and defines a main body portion 222 and a force receiver 226. The main body portion 222 is received within the second small-diameter hole 212 and is reciprocably displaceable in the longitudinal direction. The force receiver 226 is received within the second large-diameter hole 214 and is reciprocably displaceable in the longitudinal direction. The force receiver 226 has an end surface facing toward the sprocket member 13, and the end surface of the force receiver 226 receives pressure of hydraulic oil that is introduced into the second large-diameter hole 214 through the second regulation passage 216. As a result, the application of pressure generates a second regulation force that drives the second regulation member 220 in a direction away from the sprocket member 13.

As shown in FIGS. 1 and 2, the sleeve 210 of the vane rotor 14 receives therein a second regulation resilient member 230 that is made of a metal compression coil spring. The second regulation resilient member 230 extends in the longitudinal direction of the hub portion 14*a* and is interposed between the bottom part of the second large-diameter hole 214 and the second regulation member 220. The second regulation resilient member 230 applies a second restoring force, which is generated when compressed between the second large-diameter hole 214 and the second regulation member 220, to the second regulation member 220, and thereby the second regulation resilient member 230 urges the second regulation member 220 toward the sprocket member 13.

As shown in FIGS. 8F, 8H, 8J, 8L, when the main body portion 222 of the second regulation member 220 is displaced to be within the second regulation recess 202, the main body portion 222 is movable within the recess 202 in the rotational direction and is engageable with the second regulation stopper 206. As shown in FIG. 8F, when the main body portion 222 positioned within the second regulation recess 202 is engaged with the second regulation stopper 206 that is the retard end of the second regulation recess 202, the second regulation member 220 prevents the change of the rotational phase from a second regulation position further in the retard direction. More specifically, the second regulation position is located at an advance side of the first regulation position.

As shown in FIGS. 8B and 8D, when the main body portion 222 of the second regulation member 220 moves in the longitudinal direction of the second regulation member 220 against the second restoring force of the second resilient member 230, the main body portion 222 gets out of or is disengaged from the second regulation recess 202 such that the regulation of the rotational phase is removed. As a result, when the main body portion 222 is disengaged from the second regulation recess 202, and simultaneously when the main body portion 152 of the first regulation member 150 is, for example, disengaged from the first regulation recess 132 as shown in FIG. 8A, the rotational phase is allowed to freely change.

(Second Opening/Closing Structure)

As shown in FIGS. 1, 2, the drive unit 10 has a second fluid route 240. The second fluid route 240 includes a second housing passage 242 and a second rotor passage 244.

The second housing passage 242 extends through the bottom wall of the tubular portion 12*a* in the longitudinal direction of the housing 11, and has an arc shape that extends in the rotational direction of the housing 11 at a position different from the first housing passage 162. In the present embodiment, the second housing passage 242 opens at the inner periphery of the through hole formed at the bottom wall of tubular portion 12*a*. The second housing passage 242 has an opening end 242*a* formed at the side of the bottom wall remote from the vane rotor 14. Due to the above, the second housing passage 242 is communicated with the atmosphere through the opening end 242*a* and through the clearance 161 defined between the rotor bush 110 and housing bush 100.

The second rotor passage 244 has communication holes 245, 246, 247 and the second large-diameter hole 214. As shown in FIG. 2, the second timing advance communication hole 245 extends through the vane 14*c* and the sleeve 210 of the vane rotor 14 to provide communication between the advance chamber 53 and the second large-diameter hole 214. The second timing retard communication hole 246 extends through the vane 14*c* and the sleeve 140 to provide communication between the retard chamber 57 and the second large-diameter hole 214. The second atmosphere communication hole 247 extends through the vane rotor 14 and the sleeve 140 and also simultaneously opens at a position overlapping with the second housing passage 242 such that the second atmosphere communication hole 247 provides communication between the second atmosphere communication hole 247 and the second large-diameter hole 214 regardless of the change of the rotational phase. As above, the second fluid route 240 is communicated with the advance chamber 53 and the retard chamber 57.

In the second fluid route 240, the second housing passage 242 is communicated with the second atmosphere communication hole 247 of the second rotor passage 244 at a communication part. The communication part is formed radially between (a) the advance chamber 53 and the retard chamber 57 and (b) the rotation center O. In other words, the communication part is formed at a position radially inward of the imaginary cylindrical surface R shown in FIGS. 1 and 2. Due to the above, the second fluid route 240 travels along a route that is positioned radially between (a) the advance chamber 53 and the retard chamber 57 and (b) the rotation center O. Thus, the second fluid route 240 has a radially inner part that is located radially between (a) the advance chamber 53 and the retard chamber 57 and (b) the rotation center O. In other words, the radially inner part of the second fluid route 240 is located adjacent to the rotation center O on a side of the advance and retard chambers. Then, the second fluid route 240 is communicated with the atmosphere through the opening end 242*a* formed at the housing 11 at a position radially between (a) the advance chamber 53 and the retard chamber 57 and (b) the rotation center O.

The second fluid route 240 is opened and closed in accordance with a displacement position of the second regulation member 220 displaceably received within the second large-diameter hole 214 of the second fluid route 240. The second large-diameter hole 214 of the second fluid route 240 is communicated with each of the communication holes 245, 246, 247 when the second regulation member 220 is located at a position within a range from a received position as shown in FIG. 1 to a contact position as shown in FIG. 9. For example, when the second regulation member 220 is located at the received position, the second regulation member 220 is received within the second regulation recess 202, and when the second regulation member 220 is located at the contact position, the second regulation member 220 contacts the inner surface 135 of the sprocket member 13. In other words, an opening position of the second regulation member 220 for opening the second fluid route 240 corresponds to a position within the range from the received position and the contact position, and when the second regulation member 220 is located at the opening position, the communication between the advance chamber 53 and the retard chamber 57 is allowed.

In contrast, when the second regulation member 220 is located at a separate position that is separate from the inner surface 135 of the sprocket member 13 by a predetermined distance as shown in FIG. 10, the second large-diameter hole 214 of the second fluid route 240 is prevented from being communicated with each of the communication holes 245, 246, 247. In other words, a closed position of the second regulation member 220 for closing the second fluid route 240 corresponds to the above closed position, and thereby when the second regulation member 220 is located at the closed position, the communication between the advance chamber 53 and the retard chamber 57 is prohibited.

(Driving Force Control)

The control unit 30 shown in FIG. 1 has a drive passage 300 that extends through the camshaft 3 and the bearing that journals the camshaft 3. The drive passage 300 is communicated with the passages 146, 216 regardless of the change of the rotational phase. The control unit 30 has a branch passage 302 that branches from the supply passage 76 connected with the pump 4, and thereby the branch passage 302 is supplied with hydraulic oil from the pump 4 through the supply passage 76. Furthermore, the control unit 30 has a drain passage 304 that is configured to drain hydraulic oil to the oil pan 5.

A drive control valve 310 is mechanically connected with the drive passage 300, the branch passage 302, and the drain passage 304. The drive control valve 310 operates based on the energization to a solenoid 312 that is electrically connected with the control circuit 90 in order to switch a communication state between (a) the drive passage 300 and (b) one of the branch passage 302 and the drain passage 304.

When the drive control valve 310 connects the branch passage 302 with the drive passage 300, hydraulic oil from the pump 4 is introduced into the holes 144, 214 that receive therein the regulation members 150, 220, respectively, through the passages 76, 302, 300, 146, 216. As a result, in the above case, the first and second driving forces are generated to drive the respective regulation members 150, 220 in the direction toward the respective closed positions for closing the fluid routes 160, 240 against the restoring forces of the resilient members 170, 230. In contrast, when the drive control valve 310 connects the drain passage 304 with the drive passage 300, hydraulic oil in the large-diameter holes 144, 214 are drained to the oil pan 5 through the passages 146, 216, 300, 304. As a result, in the above case, the first and second driving forces are removed, and thereby the restoring forces of the resilient members 170, 230 actuate the regulation members 150, 220 in the direction toward the respective opening positions.

(Detailed Operation)

Operations of the valve timing adjuster 1 will be detailed below.

(Normal Operation)

Firstly, there is explained a normal operation, in which the internal combustion engine 2 normally stops. Three cases (I), (II), and (III) of the normal operation will be described below.

Case (I): During a normal stop, in which the internal combustion engine 2 is normally stopped in accordance with a stop command, such as OFF command of the ignition switch, the control circuit 90 controls the energization to the phase control valve 80 in order to cause the phase control valve 80 to connect the supply passage 76 with the advance passage 72. In general, when the engine 2 is stopping, the internal combustion engine 2 keeps rotating by inertia until the internal combustion engine 2 completely stops. Because the rotational speed of the internal combustion engine 2 is reduced during the normal stop, pressure of hydraulic oil, which is to be supplied from the pump 4 into the advance chambers 52, 53, 54 is also reduced accordingly. As a result, the reduction in the pressure of oil causes the reduction of the drive force applied to the vane rotor 14 due to the oil introduced to the advance chambers 52, 53, 54. Thereby, when the rotational phase is located at the retard side of the lock position, the restoring force of the urging member 120 that urges the vane rotor 14 becomes more dominant.

Also, during the normal stop of the internal combustion engine 2 in accordance with the stop command, the control circuit 90 controls the energization of the drive control valve 310 in order to cause the drive control valve 310 to connect the drain passage 304 with the drive passage 300. As a result, hydraulic oil in the large-diameter holes 144, 214 are drained, and thereby the driving force that drives each of the regulation members 150, 220 is removed. Accordingly, the restoring forces of the resilient members 170, 230 that urge the regulation members 150, 220 become dominant. In other words, the regulation members 150, 220 are urged mainly by the restoring forces of the resilient members 170, 230. Due to the above, the regulation members 150, 220 are displaced to the respective opening positions for opening the fluid routes 160, 240 such that the advance chambers 52, 53 are communicated to the atmosphere, and thereby it is possible to further reduce the driving force applied to the vane rotor 14 due to the oil introduced to the advance chambers 52, 53, 54 from the pump 4.

As a result, in the above state, it is possible to lock the rotational phase to the lock position by the operation determined in accordance with the rotational phase at the time of the normal stop, and thereby the internal combustion engine 2 will be started in the next operation under the state, where the rotational phase is locked to the lock position. The specific lock operation for locking the rotational phase at the time of the normal stop in accordance with the rotational phase will be described below.

Sub-Case (I-1): When the rotational phase at the time of normal stop corresponds to the full retard position shown in FIGS. 8A and 8B, the vane rotor 14 rotates relative to the housing 11 by the negative torque of the torque variations and by the restoring force of the urging member 120. As a result, the rotational phase is shifted in the advance direction. When the rotational phase reaches the first regulation position shown in FIGS. 8C and 8D due to the phase change in the advance direction, the main body portion 152 urged by the restoring force of the first regulation resilient member 170 is pushed into the first regulation recess 132. As a result, the rotational phase is limited from being shifted in the retard direction further from the first regulation position. When the rotational phase reaches a second regulation position shown in FIGS. 8E and 8F due to the phase change further in the advance direction, the main body portion 222 urged by the restoring force of the second regulation resilient member 230 is pushed into the second regulation recess 202. As a result, the rotational phase is limited from being shifted in the retard direction further from the second regulation position.

Then, when the rotational phase reaches the lock position shown in FIGS. 8G and 8H due to the phase change further in the advance direction, the first regulation member 150 is engaged with the first regulation stopper 137 that is located at the advance side of the first regulation recess 132. The first regulation member 150 receives the restoring force of the urging member 120, and thereby the first regulation member 150 is pressed against the first regulation stopper 137. As a result, the first regulation member 150 is fitted into the lock recess 134 due to the restoring force of the first regulation resilient member 170 as shown in FIG. 8I. Thus, the first regulation member 150 is engaged with the lock recess 134. Accordingly, the rotational phase is locked in a condition the rotational phase is regulated to the lock position.

Sub-Case (I-2): For example, when the rotational phase is positioned in a range between the full retard position and the lock position as shown in FIGS. 8C to 8F or is positioned at the lock position as shown in FIGS. 8G and 8H at the time of the normal stop, the operation similar to the operation described in the above sub-case (I-1) will be performed to the condition of sub-ease (I-2) described above. As a result, also in the present case (I-2), the rotational phase is effectively locked to the lock position.

Sub-Case (I-3): When the rotational phase is positioned at the full advance position shown in FIGS. 8K and 8L at the time of the normal stop, the second regulation member 220 receives the restoring force of the second regulation resilient member 230, and thereby is displaced into the second regulation recess 202. In the present embodiment, the application of urging force by the urging member 120 to the vane rotor 14 is limited as described above when the rotational phase is located at the advance side of the lock position. Thus, in the above insertion state, because torque variation from the internal combustion engine 2 that rotates by inertia is applied to the vane rotor 14 in the retard direction in average, the rotational phase is changed in the retard direction. When rotational phase reaches the lock position shown in FIGS. 8G and 8H due to the above phase change in the retard direction, the first regulation member 150 applied with the restoring force of the first regulation resilient member 170 is pushed into the first regulation recess 132 and into the lock recess 134, sequentially. Accordingly, the rotational phase is locked to the lock position. Note that even when the rotational phase erroneously passes the lock position to a position on a retard side of the lock position, the second regulation recess 202 is successfully and temporarily engaged with the second regulation stopper 206 at the second regulation position shown in FIG. 8F. The above happens because the second regulation member 220 has already received within the second regulation recess 202 in the above operation. As a result, subsequently, after the operation similar to the operation of the sub-case (I-2), the rotational phase is locked to the lock position.

Sub-Case (I-4): When the rotational phase is in a range between the full advance position and the lock position at the time of the normal stop, the operation similar to the operation described in the above case (I-3) is performed to the certain condition of the rotational phase during the normal stop of sub-case (I-4). As a result, in the sub-case (I-4), the rotational phase is also successfully locked to the lock position.

Next, case (II) will be described. The case (II) shows an example case, where after the above normal stop has been operated, the engine 2 is started by cranking the engine 2 in accordance with a start command, such as ON command of the ignition switch.

Case (II): When the internal combustion engine 2 is started by cranking the engine 2 in accordance with the start command after the normal stop, the control circuit 90 controls the energization to the phase control valve 80 in order to cause the phase control valve 80 to connect the supply passage 76 with the advance passage 72. As a result, hydraulic oil from the pump 4 is introduced into the advance chambers 52, 53, 54. Also, in the above case, the control circuit 90 controls the energization to the drive control valve 310 in order to cause the drive control valve 310 to connect the drain passage 304 with the drive passage 300. As a result, the introduction of hydraulic oil into the large-diameter holes 144, 214 are limited, and thereby the driving force for driving each of the regulation members 150, 220 remains removed. Accordingly, the restoring forces of the resilient members 170, 230 that urge the respective regulation members 150, 220 become dominant.

Due to the above, the final state of the above operation described in the case (I) including sub-cases (I-1), (I-2), (I-3), (I-4) is maintained. Specifically, as shown in FIGS. 8I and 8J, the first regulation member 150 remains fitted into the lock recess 134, and simultaneously the second regulation member 220 remains received by or remains within the second regulation recess 202. In general, during the cranking of the engine 2 until the engine 2 becomes self-sustaining to complete the engine start, pressure of hydraulic oil from the pump 4 remains low. As a result, even when abnormality may cause hydraulic oil to erroneously enter into the large-diameter holes 144, 214, it is possible to maintain the above final state. Therefore, it is possible to successfully lock the rotational phase to the lock position that is appropriate to start the internal combustion engine 2, and thereby the engine startability is effectively achieved.

Furthermore, in the present embodiment, the fluid routes 160, 240 are opened by maintaining the above state of the regulation members 150, 220. As a result, the advance chamber 52, 53 is communicated with the respective retard chamber 56, 57 through the respective communication hole 165, 166, 167, 245, 246, 247. Also, the advance chamber 52, 53 is communicated with or open to atmosphere through the respective fluid route 160, 240. As a result, hydraulic oil introduced from the pump 4 to the advance chamber 52, 53 is also introduced to the fluid route 160, 240 and the retard chamber 56, 57. In the above, the fluid route 160, 240 has the radially inner part located radially between (a) the retard chamber 56, 57 and (b) the rotation center O, hydraulic oil is more likely to be introduced into the retard chamber 56, 57 due to the application of the centrifugal force caused by the rotational movement. As a result, it is possible to quickly get ready for the adjustment of the valve timing adjuster 1, which adjustment will be initiated after the starting of the internal combustion engine 2.

Next, case (III) will be described. The case (III) shows an example of the operation of the engine 2 after the starting of the engine 2 has been completed, or in other words, after the engine 2 has become self-sustaining.

Case (III): After the completion of the starting of the engine 2, the control circuit 90 controls the energization to the drive control valve 310 in order to cause the drive control valve 310 to connect the branch passage 302 with the drive passage 300. As a result, hydraulic oil having increased pressure is introduced into the large-diameter holes 144, 214 through the passages 76, 302, 300, 146, 216, and thereby the driving force for driving each of the regulation members 150, 220 is generated. As a result, the first regulation member 150 is driven by the first driving force against the restoring force of the first regulation resilient member 170, and thereby the first regulation member 150 gets out of or is disengaged from both of the lock recess 134 and the first regulation recess 132. In the above state, the first regulation member 150 is displaced to the closed position, which is spaced away from the sprocket member 13 as shown in FIG. 10, and at which the first regulation member 150 closes the first fluid route 160. Also, the second regulation member 220 is driven by the second driving force against the restoring force of the second regulation resilient member 230, and thereby the second regulation member 220 gets out of the second regulation recess 202. In the above, the second regulation member 220 is displaced to the closed position, which is spaced away from the sprocket member 13 as shown in FIG. 10, and at which the second regulation member 220 closes the second fluid route 240.

As above, it is possible to prevent the leakage of hydraulic oil from the advance chambers 52, 53 and the retard chambers 56, 57 through the respective fluid routes 160, 240, and simultaneously it is possible to change the rotational phase to a required position. As a result, subsequently, the energization to the phase control valve 80 is controlled by the control circuit 90 such that hydraulic oil from the pump 4 is introduced to the advance chambers 52, 53, 54 or to the retard chambers 56, 57, 58. Thereby, it is possible to highly responsibly adjust the valve timing.

Also, during the adjustment of the valve timing in a certain situation, where the engine 2 is estimated to be stopped, such as stand-by operation, the control circuit 90 controls the energization to each control valve 80, 310 such that the rotational phase is pre-locked to the lock position. However, in the case of the above pre-lock, the restoring force of the first resilient member 170 causes the first regulation member 150 to be fitted into the lock recess 134 and to open the first fluid route 160. Simultaneously, the restoring force of the second resilient member 230 causes the second regulation member 220 to be received within the second regulation recess 202 and to open the second fluid route 240 (FIG. 1). However, hydraulic oil in the advance chamber 52, 53 and the retard chamber 56, 57 connected to the respective fluid route 160, 240 is effectively limited from leaking through the fluid route 160, 240 because hydraulic oil receives the centrifugal force, and also because the fluid route 160, 240 is communicated with atmosphere at the position radially between (a) the each chamber 52, 53, 56, 57 and (b) the rotation center O. As a result, according to the above advance lock, it is possible to effectively prevent the engine stop in a condition, where the rotational phase is displaced from the regulation position that secures the engine startability. Also, even when the engine 2 keeps operation without stopping, the rotational phase set as above is suitable for the adjustment of the valve timing in the engine operation.

(Fail-Safe Operation)

Next, a fail-safe operation executed in abnormal cases, where the engine 2 abnormally stops, will be described. In the present embodiment, three cases (i), (ii), (iii) will be described below for explaining the fail-safe operation.

Case (i) will be described below. Case (i) shows an example, in which the internal combustion engine 2 is instantly stopped due to the abnormal engagement of a clutch.

Case (i): At the time of the abnormal stop, the control circuit 90 stops the energization to the phase control valve 80, and thereby the supply passage 76 becomes connected with the advance passage 72. In the above case, pressure of hydraulic oil, which is to be introduced from the pump 4 to the advance chambers 52, 53, 54, is sharply reduced, and thereby the driving force caused by the introduced oil for driving the vane rotor 14 is removed. Accordingly, the rotational phase is maintained at a state at the time of the abnormal stop (momentary stop).

Also, at the time of the abnormal stop of the internal combustion engine 2, the control circuit 90 stops the energization to the drive control valve 310, and thereby the drain passage 304 becomes connected with the drive passage 300. As a result, similar to the normal operation case (I), the driving force for driving each of the regulation members 150, 220 is removed, and thereby the restoring forces of the resilient members 170, 230 that urge the respective regulation members 150, 220 become dominant. In other words, the regulation members 150, 220 are urged mainly by the restoring forces of the respective resilient members 170, 230.

Thus, in a case, where the rotational phase corresponds to the lock position at the time of the abnormal stop, the restoring force of the first regulation resilient member 170 causes the first regulation member 150 to be fitted into the lock recess 134. As a result, the rotational phase will remain locked to the lock position until the next starting operation of the internal combustion engine 2. However, when the rotational phase at the time of the abnormal stop is located at a position different from the lock position, it is impossible to fit the first regulation member 150 into the lock recess 134, and thereby the rotational phase will remain unlocked to the lock position until the next starting operation of the internal combustion engine 2.

Next, case (ii) will be described below. The case (ii) shows an example, in which after the above abnormal stop, the engine 2 is started in accordance with the start command.

Case (ii): When the internal combustion engine 2 is started in accordance with the start command after the above abnormal stop, the control circuit 90 controls the energization to the phase control valve 80 in order to cause the phase control valve 80 to connect the supply passage 76 with the advance passage 72. As a result, hydraulic oil from the pump 4 is supplied into the advance chambers 52, 53, 54. At the same time, the control circuit 90 controls the energization to the drive control valve 310 in order to cause the drive control valve 310 to connect the drain passage 304 with the drive passage 300. Thus, driving force of each of the regulation members 150, 220 is removed, and thereby the restoring force of each resilient member 170, 230 becomes dominant. As a result of the above, during the period before the completion of the starting of the engine 2 in the present embodiment, it is possible to lock the rotational phase to the lock position based on the operation determined by the rotational phase at the time of the abnormal stop. A lock operation in accordance with a rotational phase during the abnormal stop will be specifically described below. In a case, where the rotational phase corresponds to the lock position during the abnormal stop, when the engine 2 is started due to the operation described in the case (i), the rotational phase is locked to the lock position, and thereby the starting of the engine 2 is achievable similar to the case (II) of the normal operation. Thus, the detailed description is omitted.

Sub-Case (ii-1): In a case, where the rotational phase during the abnormal stop corresponds to the full retard position shown in FIGS. 8A and 8B, each of the regulation members 150, 220 is urged by restoring force of the respective resilient members 170, 230 at a time immediately after the engine start such that each of the regulation members 150, 220 contacts the sprocket member 13 and is located at the opening position for opening the fluid routes 160, 240 as shown in FIG. 9. Thus, when the starting of the internal combustion engine 2 is initiated in the above state, the negative torque of the variable torque and the restoring force of the urging member 120 cause the vane rotor 14 to rotate relative to the housing 11 such that the rotational phase is shifted in the advance direction. As a result, similar to the sub-case (I-1) of the above normal operation, each of the regulation members 150, 220 is sequentially displaced into the respective regulation recess 132, 202. Then, the first regulation member 150 is finally engaged with the lock recess 134. During the above operation, each of the regulation members 150, 220 remains located at the respective opening position for opening the fluid routes 160, 240 due to restoring force of the respective resilient members 170, 230 (for example, FIGS. 1, 9).

Thus, during the shift of the phase change in the advance direction, the negative torque of the variable torque is applied in the advance direction for expanding the volumes of the advance chambers 52, 53, and air is effectively suctioned into the advance chambers 52, 53 through the fluid routes 160, 240 that are communicated with atmosphere. Also, even when hydraulic oil stays in the fluid routes 160, 240 at the opening ends 162*a*, 242*a* located radially between the advance chambers 52, 53 and the rotation center O during the shift in the advance direction, the suction of the hydraulic oil into each chamber 52, 53 is assisted by centrifugal force, and thereby it is possible to reliably secure a suction route for suctioning air to the each chamber 52, 53. Due to the above, it is possible to suppress the generation of negative pressure, which may otherwise be generated due to the enlarged volume in the advance chambers 52, 53 under a substantially low-temperature state (for example, −30° C. level), where hydraulic oil has high degree of viscosity. Note that the above suppression of the generation of the negative pressure is effectively achievable in the present embodiment when the following three conditions are simultaneously satisfied. The average torque $T_{ave}$ of the variable torque is biased in the retard direction. The urging member 120 urges the vane rotor 14 in the advance direction. Also, pressure of hydraulic oil supplied by the pump 4 is low at the starting of the engine 2.

Hydraulic oil is suctioned into the advance chambers 52, 53 together with air when the volumes of the advance chambers 52, 53 are enlarged while the negative torque is applied. At this time, because hydraulic oil in each chamber 52, 53 is applied with centrifugal force in the radially outward direction, hydraulic oil is effectively limited from leaking to the exterior through the fluid routes 160, 240 located on a radially inward side of each chamber 52, 53 adjacent to the rotation center O. As a result, it is possible to effectively limit the situation, in which suctioning of air into each chamber 52, 53 is prevented because hydraulic oil in the advance chambers 52, 53 leaks to the fluid routes 160, 240.

In addition, when each of the regulation members 150, 220 opens the respective fluid route 160, 240 (or when each of the regulation members 150, 220 enables the communication between the respective fluid route 160, 240 with atmosphere), each of the advance chamber 52, 53 and the respective retard chamber 56, 57 are communicated with each other. As a result, the volumes of the advance chambers 52, 53 are enlarged by the negative torque, and simultaneously the volumes of the retard chambers 56, 57 are reduced by the negative torque. Thus, the residual hydraulic oil in the retard chambers 56, 57 for the previous operation is pushed out of the chambers 56, 57 and the hydraulic oil from the chambers 56, 57 are introduced to the advance chambers 52, 53.

As above, even when the rotational phase is located at a position different from the lock position, which serves as the regulation position, the negative torque generated during the cranking of the internal combustion engine 2 is used for shifting the rotational phase back to the lock position. As a result, regardless of the abnormal stop of the internal combustion engine 2 in the previous operation, it is possible to continue the cranking while the rotational phase is successfully locked to the lock position until the engine 2 becomes self-sustaining. In other words, regardless of the abnormal stop of the internal combustion engine 2, it is possible to effectively achieve the engine startability.

When the rotational phase during the abnormal stop of the sub-case (ii-2) is located at a position between the full retard position and the lock position shown in FIGS. 8C to 8F, for example, the operation similar to the sub-case is applicable to the rotational phase in the abnormal stop of sub-case (ii-2). As a result, in the above sub-case (ii-2), it is possible to effectively achieve the engine startability by shifting the rotational phase back to the lock position.

When the rotational phase during the abnormal stop of sub-case (ii-3) is located at the position corresponding to the full advance position shown in FIGS. 8K and 8L, the first regulation member 150 contacts the sprocket member 13 due to the restoring force of the first resilient member 170 at the time immediately before the engine start, and thereby the first regulation member 150 is located at the opening position for opening the first fluid route 160. In the above case, the second regulation member 220 at the time immediately before the engine start is located within the second regulation recess 202 due to the restoring force of the second resilient member 230, and thereby is located at the opening position for opening the second fluid route 240. Due to the above state, when the starting of the internal combustion engine 2 is initiated, hydraulic oil is introduced into the advance chambers 52, 53, 54. However, because the advance chambers 52, 53 are communicated with atmosphere through the fluid routes 160, 240, the driving force for driving the vane rotor 14 is reduced accordingly. As a result, the rotational phase is shifted to the lock position in the retard direction by the bias of the average torque $T_{ave}$ of the variable torque. Note that even when the rotational phase passes by the lock position to a position on a retard side of the lock position in the above operation, the second regulation member 220, which has already been received within the second regulation recess 202, is temporarily engaged with the second regulation stopper 206 at the second regulation position shown in FIG. 8F. As a result, subsequently, the rotational phase is successfully locked to the lock position through the operation similar to the operation of the sub-case (ii-2). Thereby, regardless of the abnormal stop of the internal combustion engine 2 in the previous operation, it is possible to continue cranking the engine 2 while the rotational phase is adjusted to the lock position within a range of the regulation position until the engine 2 becomes self-sustaining. In other words, regardless of the abnormal stop of the internal combustion engine 2, it is possible to effectively achieve the engine startability.

When the rotational phase during the abnormal stop of the sub-case (ii-4) is located at a position between the full advance position and the lock position, the operation similar to the sub-case (ii-3) is applicable to the rotational phase of the abnormal stop of the sub-case (ii-4). As a result, in the above case, it is also possible to effectively achieve the engine startability by shifting the rotational phase back to the lock position.

Case (iii): After the starting of the internal combustion engine 2 has been completed as above, the operation similar to the normal operation of the case (III) causes hydraulic oil from the pump 4 to be introduced into the advance chambers 52, 53, 54 or into the retard chambers 56, 57, 58, and thereby it is possible to highly responsively adjust the valve timing. Also, when the stop of the internal combustion engine 2 is estimated during the valve timing adjustment, the operation similar to the normal operation of the case (III) cause the rotational phase to be locked to the lock position before the stopping of the engine 2 without the leakage of hydraulic oil.

The valve timing adjuster of the present embodiment is configured to be supplied with working fluid synchronously with the operation of the internal combustion engine. In general, it is anticipated that the amount of the working fluid introduced to the specific chamber would be reduced during the starting of the internal combustion engine because the pressure of the introduced working fluid is low. Thus, negative pressure may occur in the above situation in the conventional art. However, in the present embodiment, because the fluid route, which is communicated with the specific chamber, is communicated to atmosphere, the fluid route allows air to be suctioned into the specific chamber that has the volume enlarged by variable torque (torque reversal), and thereby it is possible to successfully prevent the occurrence of the negative pressure. As a result, it is possible to secure the engine startability by effectively regulating the rotational phase back to the regulation position.

At the time of starting the internal combustion engine, the opening/closing control means of the present embodiment is capable of opening the fluid route by urging the opening/closing body to the opening position by using the restoring force generated by the resilient member. As a result, air is introduced to the specific chamber, which has the enlarged volume due to the variable torque (torque reversal), through the fluid route opened as above, and thereby it is possible to prevent the occurrence of the negative pressure. Thereby, it is possible to secure the engine startability by effectively regulating the rotational phase back to the regulation position. Furthermore, after the completion of the engine start, where working fluid has substantially high supply pressure, it is possible to close the fluid route by displacing the opening/closing body to the closed position due to pressure of the working fluid. As a result, the closure of the fluid route as above makes it possible to prevent the leakage of the working fluid from the specific chamber, and thereby it is possible to enhance the responsivity in the adjustment of the valve timing.

The fluid route of the present embodiment is communicated with both of the advance chamber and the retard chamber, both of which serve as the specific chamber. The opening/closing body provides communication between the advance chamber and the retard chamber when the opening/closing body is located at the opening position. In contrast, the opening/closing body disables communication between the advance chamber and the retard chamber when the opening/closing body is located at the closed position. Due to the fluid route and the opening/closing body as above, during the engine start, where supply pressure of working fluid is relatively low, the fluid route communicated with the advance chamber and the retard chamber is opened by urging the opening/closing body to the opening position through restoring force of the resilient member. Thereby, the communication between the advance chamber and the retard chamber is enabled. In the above open and communicated state, air is introduced through the fluid route into the specific chamber, volume of which is to be enlarged by variable torque, and simultaneously working fluid is pushed out of the other specific chamber, volume of which is to be reduced by the variable torque. As a result, at the time of starting the internal combustion engine, it is possible to increase the speed of shifting the rotational phase back to the regulation position, and thereby it is possible to effectively secure the engine startability.

In the present embodiment, the opening/closing body of the opening/closing control means is supported by one of the housing 11 and the vane rotor 14, and regulation means includes the opening/closing body of the opening/closing control means. Thus, it is possible to regulate the rotational phase by bringing the opening/closing body into the engagement with the other one of the housing 11 and the vane rotor 14 when the opening/closing body is located at the opening position. Due to the above regulation means, the opening/closing body supported by the one of the housing 11 and the vane rotor 14 is brought into engagement with the other one of the housing 11 and the vane rotor 14 by displacing the opening/closing body to the opening position before the stop of the internal combustion engine. As a result, when the internal combustion engine stops, it is possible to reliably regulate the rotational phase to the regulation position. In the above, when the opening/closing body is displaced to the opening position for opening the fluid route during the engine operation, working fluid may leak from the specific chamber through the fluid route. However, in the present embodiment, because working fluid receives centrifugal force in the specific chamber, working fluid is not likely to leak through the fluid route, which extends along the radially inner part located radially between the specific chamber and the rotation center O, and which is communicated with atmosphere via the radially inner part. As a result, during the stand-by operation, where it is estimated that the internal combustion engine may stop, it is possible to effectively prevent the engine stop in a condition, where the rotational phase is displaced from the regulation position that secures the engine startability. Simultaneously, even when the engine 2 keeps operation without stopping, the rotational phase set as above is suitable for the adjustment of the valve timing in the engine operation advantageously.

In the present embodiment, variable torque from the camshaft urges the vane rotor 14 in the retard direction in average. Thus, at the start of the internal combustion engine, the rotational phase is not likely to be shifted in the advance direction. However, in a configuration, where the fluid route, which is communicated with the specific chamber including at least advance chamber, is communicated with atmosphere, it is possible to suction air into the advance chamber, volume of which is enlarged by the variable torque, in order to prevent the occurrence of the negative pressure. As a result, it is possible to shift the rotational phase back to the regulation position even when the rotational phase is on a retard side of the regulation position. Therefore, it is possible to effectively secure the engine startability.

In the present embodiment, the urging member 120 urges the vane rotor 14 in the advance direction while the rotational phase is located on the retard side of the regulation position. In the above configuration, at the start of the internal combustion engine, the rotational phase is more likely to be shifted in the advance direction, and thereby, negative pressure may be more likely to occur in the advance chamber, volume of which is enlarged by the phase change in the advance direction. However, in the present embodiment, because the fluid route, which is communicated with the specific chamber including at least advance chamber, is communicated with the atmosphere, it is possible to introduce air into the enlarged advance chamber in order to prevent the occurrence of negative pressure. As a result, it is possible to effectively achieve the reliable engine startability by enhancing the speed of shifting the rotational phase to the regulation position.

In the first embodiment, the regulation members 150, 220, the resilient members 170, 230, the drive control valve 310, and the control circuit 90 constitutes "opening/closing control means". Each of the regulation members 150, 220 corresponds to "opening/closing body". Also, the regulation members 150, 220, the resilient members 170, 230, the drive control valve 310, the control circuit 90, and the urging member 120 constitute "regulation means". Thus, the "regulation means" also includes the regulation members 150, 220 of the "opening/closing control means". Furthermore, the advance chamber 52, 53 and the retard chamber 56, 57 correspond to "specific chamber".

Second Embodiment

Figure 11:
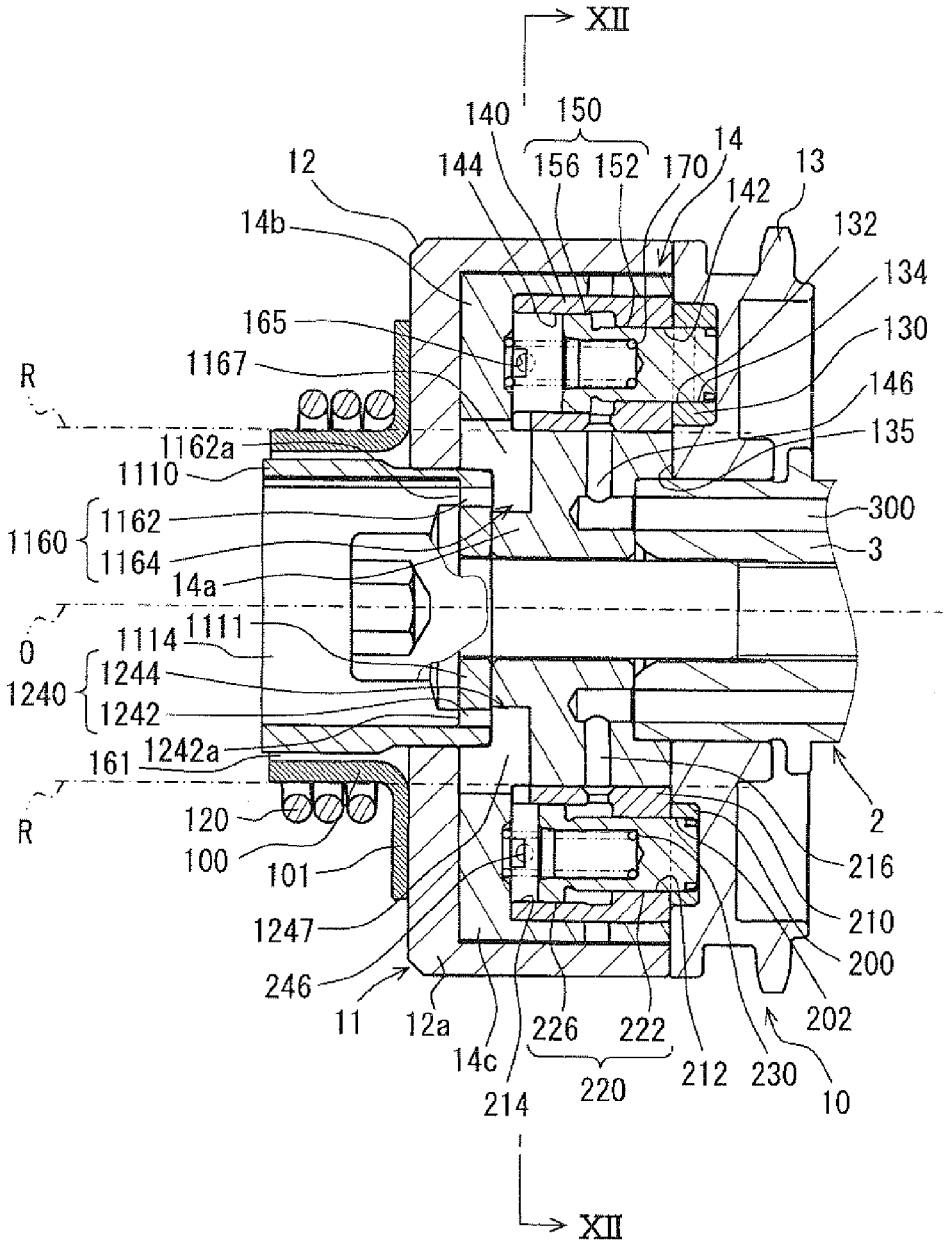
FIG. 11 is a configuration diagram of a valve timing adjuster according to the second embodiment of the present invention and is a cross-sectional view taken along line XI-XI in FIG. 12.
Figure 12:
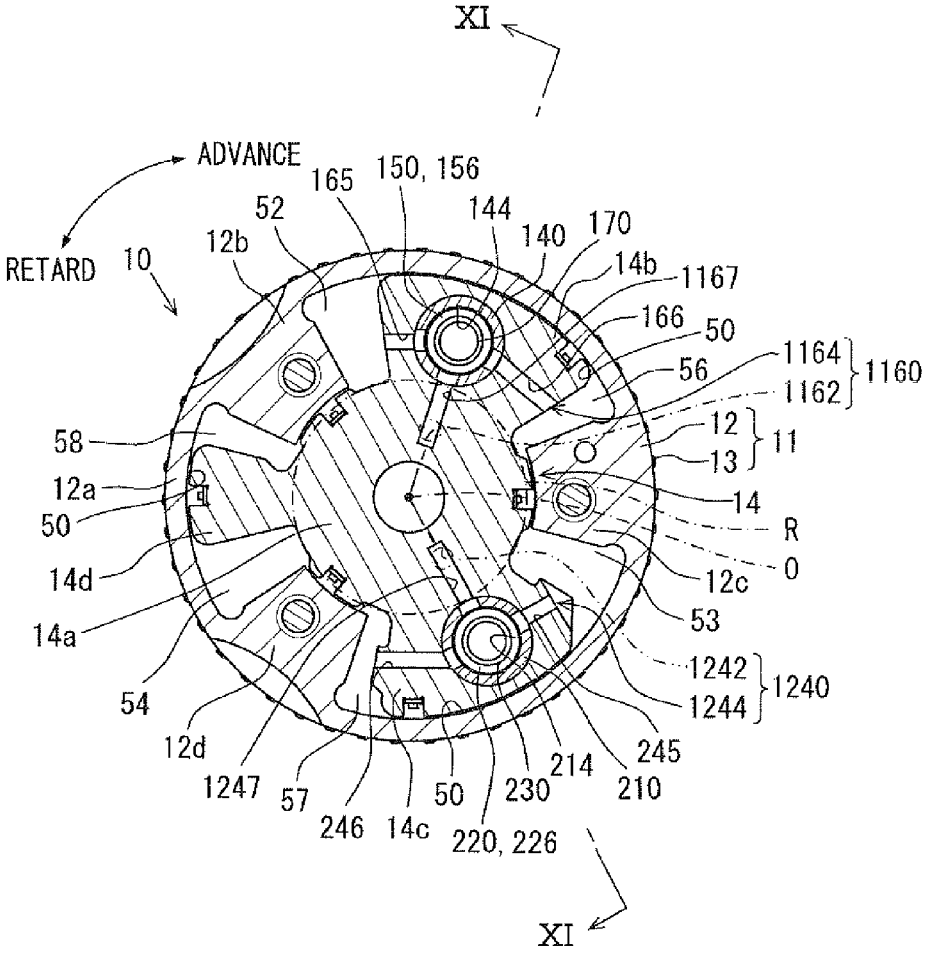
FIG. 12 is a cross-sectional view taken along line XII-XII in FIG. 11.

As shown in FIGS. 11, 12, the second embodiment of the present invention is modification of the first embodiment. A first fluid route 1160 of the second embodiment has a first bush passage 1162, which has a cylindrical hole shape, in place of the first housing passage 162. More specifically, the first bush passage 1162 extends through a bottom wall 1111 of a rotor bush 1110 of the vane rotor 14 in the axial direction of the vane rotor 14, and opens to a first atmosphere communication hole 1167 of a first rotor passage 1164 of the vane rotor 14. Due to the above, the first bush passage 1162 is communicated with atmosphere exterior of the housing 11 through an opening end 1162*a* of the passage 1162 and an inner peripheral space 1114 of the rotor bush 1110. Also, the first bush passage 1162 is always communicated with the first atmosphere communication hole 1167.

Similarly, a second fluid route 1240 of the second embodiment includes a second bush passage 1242, which has a cylindrical hole shape, in place of the second housing passage 242. More specifically, the second bush passage 1242 extends through the bottom wall 1111 of the rotor bush 1110 of the vane rotor 14 in the axial direction of the vane rotor 14, and opens to a second atmosphere communication hole 1247 of a second rotor passage 1244 of the vane rotor 14. Due to the above, the second bush passage 1242 is communicated with atmosphere through the inner peripheral space 1114 of the rotor bush 1110 and an opening end 1242*a* of the passage 1242, and is always communicated with the second atmosphere communication hole 1247.

In each of the fluid routes 1160, 1240, the bush passage 1162, 1242 is communicated with the respective atmosphere communication hole 1167, 1247 at the communication part of the passage 1162, 1242, which part is located radially between (a) the respective advance chamber 52, 53 and the respective retard chamber 56, 57 and (b) the rotation center O. In other words, the bush passage 1162, 1242 is located at a radially inner side of the imaginary cylindrical surface R shown in FIGS. 11, 12 such that the bush passage 1162, 1242 is located adjacent to the rotation center O on a side of the respective advance chamber 52, 53 and the respective retard chamber 56, 57. As a result, each of the fluid routes 1160, 1240 of the second embodiment travels along a route located radially between (a) the advance chamber 52, 53 and the retard chamber 56, 57 and (b) the rotation center O, and is communicated with atmosphere through the opening end 1162*a*, 1242*a* formed at the vane rotor 14 on a side of the chambers adjacent to the rotation center O.

According to the second embodiment, due to the operation similar to the first embodiment, it is possible to achieve advantages similar to the advantages of the first embodiment by opening and closing each of the fluid routes 1160, 1240 as required.

Third Embodiment

Figure 13:
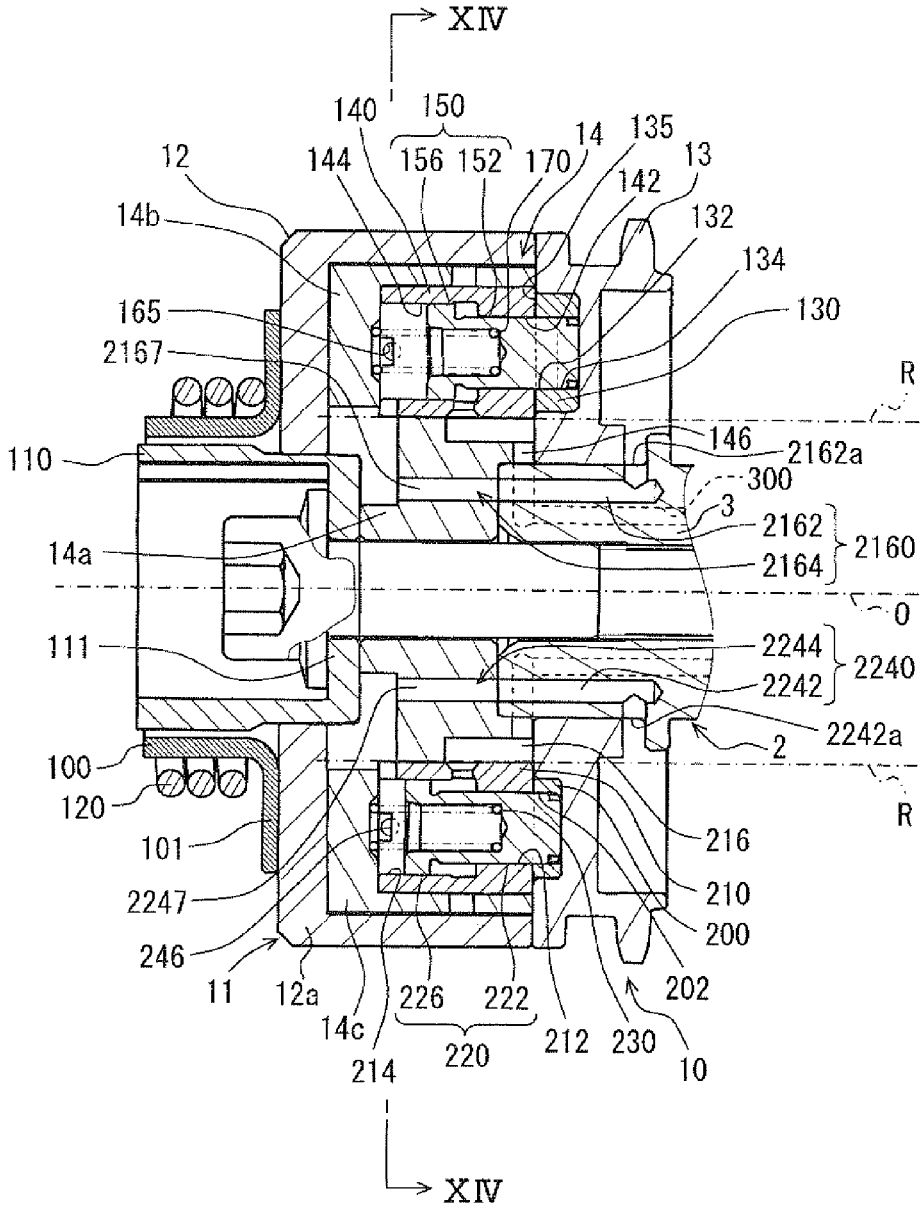
FIG. 13 is a configuration diagram of a valve timing adjuster according to the third embodiment of the present invention and is a cross-sectional view taken along line XIII-XIII in FIG. 14.
Figure 14:
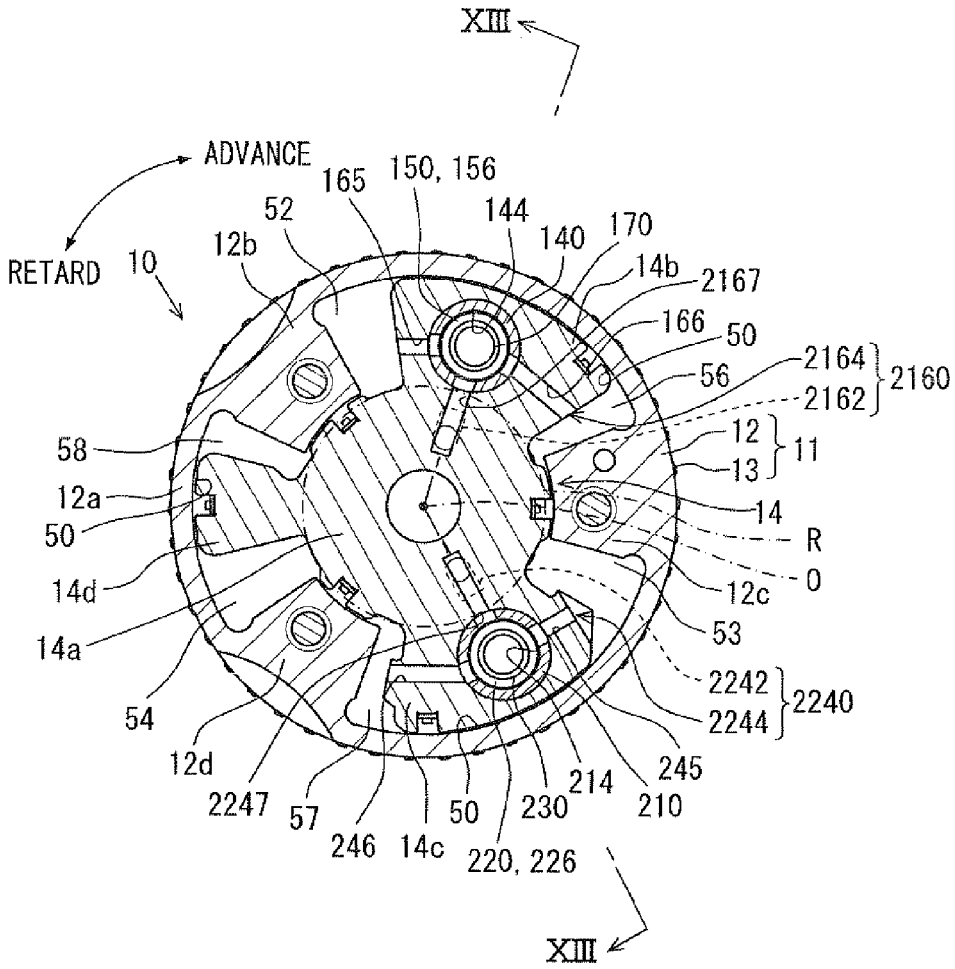
FIG. 14 is a cross-sectional view taken along line XIV-XIV in FIG. 13.

As shown in FIGS. 13, 14, the third embodiment of the present invention is modification of the first embodiment. A first fluid route 2160 of the third embodiment includes a first cam passage 2162, which has a cylindrical hole shape, in place of the first housing passage 162. More specifically, the first cam passage 2162 extends through the camshaft 3 to form an L shape, and opens to a first atmosphere communication hole 2167 of a first rotor passage 2164 of the vane rotor 14. Due to the above, the first cam passage 2162 is always communicated with the first atmosphere communication hole 2167, and is communicated with atmosphere outside the housing 11 through an opening end 2162*a* located on a side of the first cam passage 2162 remote from the communication hole 2167.

Similarly, a second fluid route 2240 of the third embodiment includes a second cam passage 2242, which has a cylindrical hole shape, in place of the second housing passage 242. More specifically, the second cam passage 2242 extends through the camshaft 3 to form an L shape, and opens to a second atmosphere communication hole 2247 of second rotor passage 2244 of the vane rotor 14. Due to the above, the second cam passage 2242 is always communicated with the second atmosphere communication hole 2247, and is communicated with atmosphere through an opening end 2242*a* located on a side of the second cam passage 2242 opposite from the communication hole 2247.

In each of the fluid routes 2160, 2240, the cam passage 2162, 2242 is communicated with the atmosphere communication hole 2167, 2247 at the communication part located radially between (a) the respective advance chamber 52, 53 and the respective retard chamber 56, 57 and (b) the rotation center O. In other words, the communication part of the atmosphere communication hole 2167, 2247 is formed radially inward of the imaginary cylindrical surface R shown in FIGS. 13, 14. As a result, each of the fluid routes 2160, 2240 of the third embodiment travels along a route that is located radially between (a) the advance chamber 52, 53 and the retard chamber 56, 57 and (b) the rotation center O, and is communicated with atmosphere through the opening end 2162*a*, 2242*a* formed to the vane rotor 14 on a side of the respective chambers adjacent to the rotation center O.

According to the third embodiment, each of the fluid routes 2160, 2240 is opened and closed due to the operation similar to the operation of the first embodiment such that the advantages similar to the advantages of the first embodiment are achievable.

Other Embodiment

While the present invention has been described in connection with the above embodiments, the invention is not interpreted limitedly to those specific embodiments. On the contrary, the invention is applicable to various modifications and equivalents within the spirit and scope of the invention.

Specifically, in the first to third embodiments, the group of the second regulation recess 202, the second regulation member 220, the second resilient member 230, and the respective second fluid route 240, 1240, 2240 may be removed. Alternatively, the group of the first regulation and lock recesses 132, 134, the first regulation member 150, the first resilient member 170 and the respective first fluid route 160, 1160, 2160 may be removed. Also, in the first to third embodiments, the regulation members 150, 220 serving as "opening/closing body" may be received and supported by the housing 11, and the regulation members 150, 220 may be brought into engagement with the vane rotor 14 such that the rotational phase is regulated to the regulation position. Furthermore, in the first to third embodiments, "opening/closing body" may be structured such that the function similar to the function of the regulation member 150, 220 may be alternatively achieved by the combination of multiple members.

Further, in the first to third embodiments, at least one of the first fluid route 160, 1160, 2160 and the second fluid route 240, 1240, 2240 may be opened and closed by a dedicated "opening/closing body" that is different from the respective regulation member 150, 220. In the above alternative case, the dedicated "opening/closing body" may have a structure similar to the structure of the regulation member 150, 220 except that the dedicated "opening/closing body" is not brought into the respective recess 132, 134, 202. More specifically, when the dedicated "opening/closing body" is reciprocably moved by (a) the introduction and discharge of hydraulic oil through the drive passage 300 and (b) restoring force of a dedicated "resilient member", the advantages similar to the advantages of the first to third embodiments are achievable in the above alternative case.

In addition to the above, in the first to third embodiments, an entirety of the fluid route 160, 1160, 2160, 240, 1240, 2240 may be provided on a side of the advance chamber 52, 53 and the retard chamber 56, 57 serving as "specific chamber" adjacent to the rotation center O. In other words, the entirety of the fluid route 160, 1160, 2160, 240, 1240, 2240 may be provided radially between (a) the advance chamber 52, 53 and the retard chamber 56, 57 and (b) the rotation center O. In the first to third embodiments, the fluid route 160, 1160, 2160, 240, 1240, 2240 may disconnected from the respective retard chamber 56, 57. Furthermore, the bush passage 1162, 1242 of the fluid route 1160, 1240 of the second embodiment may be added to the respective fluid route 160, 240 of the first embodiment. Alternatively, the cam passage 2162, 2242 of the fluid route 2160, 2240 of the third embodiment may be added to the fluid route 160, 240 of the first embodiment. Further alternatively, both of the bush passage 1162, 1242 and the cam passage 2162, 2242 may be added to the fluid route 160, 240 of the first embodiment.

In addition to the above, in the first to third embodiments, the group of the urging member 120 and the groove 102, 112 may be alternatively removed. The present invention may be alternatively applicable to an apparatus that adjusts valve timing of an exhaust valve serving as a "valve" and also to an apparatus that adjusts valve timing of both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing adjuster for an internal combustion engine having a crankshaft and a camshaft, wherein the valve timing adjuster adjusts valve timing of a valve, which is opened and closed by the camshaft through torque transmission from the crankshaft, wherein the valve timing adjuster uses working fluid supplied from a supply source in order to adjust the valve timing, the valve timing adjuster comprising:

a housing that is rotatable synchronously with the crankshaft around a rotation center;

a vane rotor that is rotatable synchronously with the camshaft around the rotation center, wherein:

the vane rotor has a vane that divides an internal space of the housing into an advance chamber and a retard chamber arranged one after another in a rotational direction of the vane rotor;

when working fluid is introduced into the advance chamber, a rotational phase of the vane rotor relative to the housing is shifted in an advance direction; and when working fluid is introduced into the retard chamber, the rotational phase is shifted in a retard direction;

a regulator configured to regulate the rotational phase to a regulation position located between a full advance position and a full retard position;

a fluid route communicated with a specific chamber that is at least one of the advance chamber and the retard chamber, the fluid route extending via a radially inner part to be communicated with atmosphere, the radially inner part being located radially between the specific chamber and the rotation center; and opening/closing controller configured to open and close the fluid route, wherein working fluid is supplied from the supply source synchronously with operation of the internal combustion engine, the opening/closing controller includes:

an opening/closing body that is displaceable to a closed position by pressure received from working fluid, the opening/closing body closing the fluid route when the opening/closing body is located at the closed position; and a resilient member that generates restoring force for urging the opening/closing body toward an opening position, at which the opening/closing body opens the fluid route, the opening/closing body is supported by the vane rotor;

the regulator includes the opening/closing body of the opening/closing controller; and the regulator regulates the rotational phase by bringing the opening/closing body located at the opening position into engagement with a recess of the housing, and the opening/closing body is moved from the closed position to the opening position when a driving force driving the opening/closing body by the pressure received from working fluid is eliminated in the state where the opening/closing body is out of the recess such that the rotational phase is located at a position different from the regulation position, wherein:

the specific chamber includes both of the advance chamber and the retard chamber;

the fluid route is communicated with both of the advance chamber and the retard chamber;

the opening/closing body provides communication between the advance chamber and the retard chamber when the opening/closing body is located at the opening position; and the opening/closing body disables communication between the advance chamber and the retard chamber when the opening/closing body is located at the closed position.

2. A valve timing adjuster for an internal combustion engine having a crankshaft and a camshaft, wherein the valve timing adjuster adjusts valve timing of a valve, which is opened and closed by the camshaft through torque transmission from the crankshaft, wherein the valve timing adjuster uses working fluid supplied from a supply source in order to adjust the valve timing, the valve timing adjuster comprising:

a housing that is rotatable synchronously with the crankshaft around a rotation center;

a vane rotor that is rotatable synchronously with the camshaft around the rotation center, wherein:

the vane rotor has a vane that divides an internal space of the housing into an advance chamber and a retard chamber arranged one after another in a rotational direction of the vane rotor;

when working fluid is introduced into the advance chamber, a rotational phase of the vane rotor relative to the housing is shifted in an advance direction; and when working fluid is introduced into the retard chamber, the rotational phase is shifted in a retard direction;

a regulator configured to regulate the rotational phase to a regulation position located between a full advance position and a full retard position;

a fluid route communicated with a specific chamber that is at least one of the advance chamber and the retard chamber, the fluid route extending via a radially inner part to be communicated with atmosphere, the radially inner part being located radially between the specific chamber and the rotation center; and opening/closing controller configured to open and close the fluid route, wherein working fluid is supplied from the supply source synchronously with operation of the internal combustion engine, the opening/closing controller includes:

an opening/closing body that is displaceable to a closed position by pressure received from working fluid, the opening/closing body closing the fluid route when the opening/closing body is located at the closed position; and a resilient member that generates restoring force for urging the opening/closing body toward an opening position, at which the opening/closing body opens the fluid route, the opening/closing body is supported by the vane rotor;

the regulator includes the opening/closing body of the opening/closing controller; and the regulator regulates the rotational phase by bringing the opening/closing body located at the opening position into engagement with a recess of the housing, and the opening/closing body is moved from the closed position to the opening position when a driving force driving the opening/closing body by the pressure received from working fluid is eliminated in the state where the opening/closing body is out of the recess such that the rotational phase is located at a position different from the regulation position, wherein:

the vane is one of a plurality of vanes of the vane rotor;

the opening/closing body is one of a plurality of opening/closing bodies; and each of the plurality of opening/closing bodies is supported by a corresponding one of the plurality of vanes of the vane rotor.

3. The valve timing adjuster according to claim 1 or 2, wherein:

the fluid route has an opening end that is communicated with atmosphere at a position located radially between the specific chamber and the rotation center.

4. A valve timing adjuster for an internal combustion engine having a crankshaft and a camshaft, wherein the valve timing adjuster adjusts valve timing of a valve, which is opened and closed by the camshaft through torque transmission from the crankshaft, wherein the valve timing adjuster uses working fluid supplied from a supply source in order to adjust the valve timing, the valve timing adjuster comprising:

a housing that is rotatable synchronously with the crankshaft around a rotation center;

a vane rotor that is rotatable synchronously with the camshaft around the rotation center, wherein:

the vane rotor has a vane that divides an internal space of the housing into an advance chamber and a retard chamber arranged one after another in a rotational direction of the vane rotor;

when working fluid is introduced into the advance chamber, a rotational phase of the vane rotor relative to the housing is shifted in an advance direction; and when working fluid is introduced into the retard chamber, the rotational phase is shifted in a retard direction;

a regulator configured to regulate the rotational phase to a regulation position located between a full advance position and a full retard position;

a fluid route communicated with a specific chamber that is at least one of the advance chamber and the retard chamber, the fluid route extending via a radially inner part to be communicated with atmosphere, the radially inner part being located radially between the specific chamber and the rotation center; and opening/closing controller configured to open and close the fluid route, wherein working fluid is supplied from the supply source synchronously with operation of the internal combustion engine, the opening/closing controller includes:

an opening/closing body that is displaceable to a closed position by pressure received from working fluid, the opening/closing body closing the fluid route when the opening/closing body is located at the closed position; and a resilient member that generates restoring force for urging the opening/closing body toward an opening position, at which the opening/closing body opens the fluid route, the opening/closing body is supported by the vane rotor;

the regulator includes the opening/closing body of the opening/closing controller; and the regulator regulates the rotational phase by bringing the opening/closing body located at the opening position into engagement with a recess of the housing, and the opening/closing body is moved from the closed position to the opening position when a driving force driving the opening/closing body by the pressure received from working fluid is eliminated in the state where the opening/closing body is out of the recess such that the rotational phase is located at a position different from the regulation position, wherein the fluid route is communicated with atmosphere through a part of the camshaft, which part is located radially between the specific chamber and the rotation center.

5. The valve timing adjuster according to claim 1, 2, or 4, wherein:

variable torque transferred from the camshaft is applied to the vane rotor such that variable torque urges the vane rotor in the retard direction in average; and the specific chamber includes at least the advance chamber.

6. The valve timing adjuster according to claim 5, wherein:

the regulator includes an urging member that urges the vane rotor in the advance direction while the rotational phase is located at a retard side of the regulation position.

7. The valve timing adjuster according to claim 1 or 2, wherein the fluid route is communicated with atmosphere through a part of the housing, which part is located radially between the specific chamber and the rotation center.

8. The valve timing adjuster according to claim 1 or 2, wherein the fluid route is communicated with atmosphere through a part of the vane rotor, which part is located radially between the specific chamber and the rotation center.

* * * * *